US005338380A

United States Patent [19]

Yutori et al.

[11] Patent Number: 5,338,380

[45] Date of Patent: Aug. 16, 1994

[54] HIGH STRENGTH LOW CARBON STEEL WIRE RODS AND METHOD OF PRODUCING THEM

[75] Inventors: Toshiaki Yutori, Hyogo; Masaaki Katsumata, Nishi; Takehiko Kato, Kita; Yasuhiro Hosogi, Hyogo, all of Japan

[73] Assignee: Kabushiki Kaisha Kobe Seiko Sho, Kobe, Japan

[21] Appl. No.: 888,865

[22] Filed: May 27, 1992

Related U.S. Application Data

[60] Division of Ser. No. 629,035, Dec. 19, 1990, Pat. No. 5,141,570, which is a continuation of Ser. No. 235,797, Aug. 23, 1988, abandoned, which is a continuation of Ser. No. 895,869, Aug. 12, 1986, abandoned.

[30] Foreign Application Priority Data

| | | | |
|---|---|---|---|
| Aug. 29, 1985 | [JP] | Japan | 60-191024 |
| Aug. 29, 1985 | [JP] | Japan | 60-191026 |
| Nov. 6, 1985 | [JP] | Japan | 60-249559 |
| Nov. 6, 1985 | [JP] | Japan | 60-249560 |

[51] Int. Cl.[5] ..... C21D 8/06

[52] U.S. Cl. ..... 148/532; 148/534; 148/599

[58] Field of Search ..... 148/530, 534, 595, 598, 148/599, 532

[56] References Cited

U.S. PATENT DOCUMENTS

| | | | |
|---|---|---|---|
| 2,563,113 | 8/1951 | Hindin et al. | 428/677 |
| 3,939,015 | 2/1976 | Grange | 148/595 |
| 4,067,756 | 1/1978 | Koo et al. | 420/117 |
| 4,265,678 | 5/1981 | Hachisuka et al. | 148/530 |
| 4,332,630 | 6/1982 | Economopoulos et al. | 148/595 |
| 4,388,122 | 6/1983 | Sudo et al. | 148/320 |
| 4,501,626 | 2/1985 | Sudo et al. | 148/320 |
| 4,578,124 | 3/1986 | Yutori et al. | 148/320 |
| 4,613,385 | 9/1986 | Thomas et al. | 148/599 |
| 4,619,714 | 10/1986 | Thomas et al. | 148/599 |
| 5,017,248 | 5/1991 | Kawano et al. | 148/320 |

FOREIGN PATENT DOCUMENTS

| | | | |
|---|---|---|---|
| 60-184644 | 9/1985 | Japan | 148/320 |
| 61-153260 | 7/1986 | Japan | 420/120 |

*Primary Examiner*—George Wyszomierski

*Attorney, Agent, or Firm*—Oblon, Spivak, McClelland, Maier & Neustadt

[57] ABSTRACT

High strength low carbon steel wire rods excellent in the cold drawing property have a composite structure in which an acicular low temperature transformation phase comprising a martensite, bainite and/or the mixed structure thereof that comprises, by weight %,

C: 0.02–0.30%,

Si: less than 2–5%,

Mn: less than 2.5% and the balance of iron and inevitable impurities and that may partially contain retained austenite is uniformly dispersed at the volume ratio of from 10 to 70% in the ferrite phase, and in which the weight of (C+N) in solution the ferrite phase is less than 40 ppm.

6 Claims, 13 Drawing Sheets

HIGH STRENGTH LOW CARBON STEEL WIRE RODS AND METHOD OF PRODUCING THEM

This is a division of application Ser. No. 07/629,035, filed on Dec. 19, 1990, now U.S. Pat. No. 5,141,570, which is a continuation of Ser. No. 07/235,797 filed Aug. 23, 1988 now abandoned, which is a continuation of Ser. No. 06/895,869 filed Aug. 12, 1986 now abandoned.

BACKGROUND OF THE INVENTION

1. Field of the Invention

This invention relates to high strength low carbon steel wire rods having excellent cold drawing properties and to a method of producing them. This invention further relates to a method of producing ultra-fine steel wires using the high strength low carbon steel wire rods and also to brass-plated ultra-fine steel wires.

2. Description of the Prior Art

Steel wires drawn from steel wire rods into diameters from several millimeters to several tens of micrometers have been used, depending on their diameters, in various applications such as PC wires, various kinds of spring wires, rope wires, tire bead wires, tire cord wires, high pressure hose wires, switching wires, corona wires and dot printer wires. Since ultra-fine steel wires are usually produced from rolled wire rods of high carbon steel of about 5.5 mm diameter by several cold drawing steps during each of which steps reduction in the toughness of drawn wire rods is prevented by the application of a patented treatment several times during the course of production, a number of production steps are required and accordingly the production costs inevitably increase.

On the other hand, it is also possible to draw ultra-fine wires by intense work from steel wire rods made of pure iron or low carbon ferrite-pearlite steels, but the strength of the ultra-fine wire products is low since their strength is diminished by the drawing operation. That is, even in the drawn wires subjected to intense work at a rate of 95–99%, the strength of the drawn wires is only from 70 to 130 kgf/mm$^2$ and strengths greater than 170 kgf/mm$^2$ cannot be attained. Further, even at drawing at a rate greater than 99%, the strength is still lower than 190 kgf/mm$^2$.

Wire rods having a tempered martensite structure prepared by the heat treatments of hardening and tempering are also known. However, since no wire rods having the desired workability can be obtained by hardening of the rods, workability has only been obtained by significantly reducing the strength of the wire rods by a tempering treatment and, accordingly, strong and ductile steel wires cannot be obtained. Moreover, hardened wire rods suffer from surface cracking during the pickling step which is applied as a treatment prior to the drawing step. The rods also inevitably exhibit insufficient ductility.

The present inventors have conducted intensive studies for the preparation of high strength and highly ductile steel wire rods instead of conventional ferrite-pearlite wire rods, pearlite wire rods and tempered martensite wire rods and, as a result, have found that steel wire rods having composite structures in which a fine low temperature transformation phase comprising an acicular bainite, martensite and/or mixed structure thereof that comprises predetermined chemical compositions and may partially contain retained austenite is uniformly dispersed in a ferrite phase, have excellent intense workability. The inventors have already filed a U.S. patent application based on such findings which is now U.S. Pat. No. 4,578,124. However, it has also been found that even the steel wire rods having such excellent cold drawing properties show degradation in ductility and sometimes break when drawn at a drawing speed of higher than 20 m/min. Such a degradation in ductility is a problem characteristic of composite structures in general and are not restricted only to the acicular structure, when the steel wire rods, before drawing, are subjected to quenching.

Specifically, upon high speed drawing, ductility degrades even in steel wire rods which have a metal structure which exhibit cold drawing properties because of the temperature increase during drawing work because of the high aging effect. In addition, the effect of hydrogen tends to develop when the strength of the drawn wire rod is increased by the drawing work and the tensile strength increases to greater than about 150 kgf/mm$^2$. The effect of hydrogen is particularly significant in the case where the strength is greater than about 200 kgf/mm$^2$.

For instance, FIG. 1 shows the tensile strength and the reduction of area at break of a drawn wire obtained from a high strength wire rod of 7.5 mm diameter having a mixed structure comprising 8% ferrite and 92% martensite prepared by rolling and then directly hardening the steel material represented by the reference R2 and having chemical compositions shown in Table 1 at a drawing speed of 1 m/min or 50 m/min. That is, a drawn wire of high strength greater than 200 kgf/mm$^2$ and high ductility can be obtained at a working rate of 70 to 80% in the case of using a drawing speed of m/min. However, since the ductility begins to degrade in the drawn wire at about 50% working rate in the case of a drawing speed of 50 m/min, it is difficult to obtain a highly ductile drawn wire with a strength greater than 200 kgf/mm$^2$.

Further, steel materials represented by steel No. A and having the chemical compositions shown in Table 1 are rolled into wire rods, followed by direct hardening to obtain a wire rod of 5.5 mm diameter having a structure mainly composed or martensite, which are reheated into a ferrite-austenite 2-phase region followed by water cooling to obtain an intensely workable wire rod having a mixed structure, in which fine acicular martensite is uniformly dispersed by 21% volume ratio into the ferrite phase. Then the wire rod is drawn at a low speed or drawn at a speed of 30–530 m/min. As shown by the result in FIG. 2, a high strength drawn wire having a tensile strength greater than 320 kgf/mm$^2$ can be obtained at 99.9% working rate in the case of a drawing speed of 1 m/min, but it is difficult to obtain a drawn wire having a tensile strength greater than 200 kgf/mm$^2$ in the case of the continuous drawing at a speed or 30–530 m/min since the ductility begins to degrade from a working rate of about 95%.

SUMMARY OF THE INVENTION

In view of the above, the present inventors have made an earnest study to overcome the foregoing problems and, as a result, have found that drawn steel wires having stably high ductility can be obtained irrespective of the wire drawing speed, by a method of producing steel wire rod of a composite structure having a low temperature transformation phase comprising martensite, bainite and/or mixed structure thereof which may contain austenite by the rolling of steels having predetermined chemical compositions into wire rods or by reheating the wire rods followed by cooling, wherein the wire rods are dehydrogenated under a predetermined condition in the above-mentioned cooling step thereby restricting the weight of (C+N) solid-solubilized into the ferrite phase in the metal texture of the wire rods to less than 40 ppm, which maintains the excellent workability inherent to such a structure. It has further been found that highly ductile drawn wires can also be obtained stably irrespective of the drawing speed by producing the wire rods of the composite structure as described above and then applying an over aging treatment under a predetermined condition.

Furthermore, the present inventors have found that steel wire rods more excellent in intense workability can be obtained by re-heating the wire rods having the foregoing composite structure, following by cooling to transform the low temperature transformation phase into a fine acicular structure and then applying the dehydrogenation or over aging treatment to these wire rods.

Accordingly, a primary object of this invention is to provide high strength steel wire rods which exhibit excellent cold drawing properties, as well as a method of producing them, particularly, high strength steel wire rods having excellent cold drawing properties which are capable of providing high strength and highly ductile drawn wires having a tensile strength greater than 150 kgf/mm$^2$, preferably, greater than 200 kgf/mm$^2$, and to provide a method of producing drawn wire by drawing the wire rods at a drawing speed higher than 20 m/min and at a total reduction of area greater than 30%.

Furthermore, the present inventors have found that ultra-fine steel wires having higher strength and higher ductility can be obtained by applying, to the wire rods of the aforementioned composite structure for use in cold wire drawing, a heat treatment comprising heating the rods to a temperature lower than the recrystallization point and subsequent cooling in the course of the cold drawing and further applying the drawing work.

In the case of producing ultra-fine steel wires with a diameter of several tens of micrometers from wire rods of the aforementioned composite structure by cold drawing at a total reduction of area greater than 99.0% optimally, 99.9%, since the strength of the intermediate drawn wire and that of the finally obtained ultra-fine steel wire are substantially determined solely by the strength of the wire rods having the composite structure, wire drawing is normally applied to wire materials of unnecessarily high strength repeatedly which reduces the life of the dies and damages the ductility of the wire. Particularly, if the strength of the drawn wire rods exceeds 300 kgf/mm$^2$, the dies' life is remarkably reduced.

The present inventors have found that the strength of the drawn wire rods can be adjusted to a desired value by applying a heat treatment comprising heating to a temperature lower than the recrystallization point and then subsequently cooling once or several times during the course of the drawing work upon producing ultra-fine steel wires from the wire rods having the composite structure as described above by cold wire drawing, particularly, at the total reduction of area greater than 99.9%. Further, ultra-fine steel wires having a final strength of greater than 300 kgf/mm$^2$ can be obtained while preventing reduction in the life of dies by controlling the strength of the drawn wire material by the heat treatment.

Accordingly, a secondary object of this invention is to provide ultra-fine steel wires of high strength and high ductility from low carbon steel wire rods having a predetermined composite structure, as well as to provide a method of producing ultra-fine steel wires having improved strength, particularly, in the case of producing ultra-fine steel wires by drawing to a total reduction of area greater than 90%. Further, a method of producing ultra-fine steel wires is provided which does not reduce die life by applying drawing while controlling the strength of the intermediate drawn wires at a total reduction of area greater than 99%.

Further, wire rods having the above-mentioned composite structure can also be applied to steel wires having brass-plated layers on their surface as such wires are used as tire cord wire, high pressure hose wires, and the like. Since these brass-plated ultra-fine steel wires have usually been produced by preparing ultra-fine steel wires of a predetermined diameter by several steps of cold drawing while applying a patenting treatment several times over the course of the drawing work to rolled high carbon steel wire rods of 5.5 mm diameter in order to prevent reduction in the toughness of the drawn wire material at each drawing step and then applying brass plating thereto, a number of production steps are required and the production costs inevitably increase.

Since the lubricating treatment has usually been conducted by means of phosphate coating in the continuous cold drawing of the wire rods in the above application, lubrication for the drawing work becomes difficult along with an increase in the working rate, and no ultra-fine steel wires with uniform surface properties can be obtained because of the insufficient lubricating performance in the case of applying continuous cold wire drawing at a reduction of area greater than 90%, preferably, 98%. This is attributable to the fact that non-uniform deformed layers are formed at the outermost surface of the drawn rods where the drawn rods and dies are in contact upon continuous wire drawing. Such uniform deformed layers grow and develop in every die, and the development of these deformed layers substantially increase as the rate of working increases in which the not-uniform deformed layers are extended to such a degree that the ductility of the drawn wires is damaged. In the conventional high carbon steel wire rod, since the patenting treatment in is applied over the course of the working the non-uniform deformed layers do not accumulate and extend, because of the insufficiency in the intense workability of the wire rod material.

More specifically, if the lubricating performance worsens during drawing, since metal-to-metal contact occurs between the drawn wire rod and the dies, the surface of the drawn wire rod is made smooth, which means that the powdered lubricant deposits to less of an extent on the wire rod surface thereby reducing the amount of lubricant introduced into the dies. The amount of the lubricant deposited in the drawn wire rod is an index which represents the lubricating performance, which is made smaller as the die angle is made larger or the drawing speed becomes faster. Further, the amount of lubricant deposited significantly reduces as a function of the number of dies, that is, the number of repeat passes increases.

FIG. 13 illustrates the change in the amount of lubricant deposited depending on the increase in the number of passes of the drawing wires regarding the conventional wire rods of high carbon steels subjected to lead patenting (LP) and wire rods having the composite structure with the intense workability as described above. As shown by curves II and III, when the wire rods of the foregoing composite structure are subjected to continuous cold drawing at a total reduction of area greater than 90%, since the number of passes for the wires increases and the amount of the lubricant significantly decreases along with the increased number of passes, cold drawing inevitably suffers from poor lubricity and, as a result, the ductility of the drawn wires degrades.

The present inventors have found, for the method of producing brass-plated ultra-fine steel wires by using wire rods of intense workability which have a composite structure that brass-plated ultra-fine steel wires of high strength and high ductility can directly be obtained without requiring heat treatment such as patenting in the course of the drawing, by applying brass-plating before or during the continuous cold wire drawing of the wire rods of the composite structure and utilizing the lubricating effect of the plated layer.

In view of another aspect, the ultra-fine steel wires brass-plated at the surface have been produced by applying patenting treatment during drawing of the wire rods or by applying brass-plating to the drawn wires after the drawing. While on the other hand, according to this invention, brass plating is applied before or during the drawing work, whereby continuous drawing can be carried out with ease at a reduction of area greater than 98% and, preferably, greater than 99% because of the lubricating effect of the plating, and brass-plated ultra-fine steel wires can be obtained without requiring parenting or other similar heat treatment. Moreover, since the ductility is improved and the homogenization of the plated layer is enhanced by the intense work after the plating of the brass-plated ultra-fine steel wires obtained in such a method, close bondability with rubber can significantly be improved.

Accordingly, the third object of this invention is to provide brass-plated ultra-fine steel wires and a method of producing the same and, in particular, brass-plated ultra-fine steel wires prepared from low carbon steel wire rods having a predetermined structure by applying continuous cold wire drawing after brass-plating. Ductility is unproved and the close bondability with rubber is outstanding because of the unified and homogenized plated layer.

The high strength low carbon steel wire rods which have excellent cold drawing properties for attaining the primary object of this invention comprises a composite structure in which an acicular low temperature transformation phase comprising a martensite, bainite and/or the mixed structure thereof that comprises, by weight %,

C: 0.02–0.30%,

Si: less than 2.5%,

Mn: less than 2.5%, and the balance of iron and inevitable impurities and that may partially contain retained austenite, is uniformly dispersed in the ferrite phase at a volume ratio of from 10 to 70%, and the weight or (C+N) solid-solubilized in the ferrite phase is less than 40 ppm.

Further, the method of producing high strength low carbon steel wire rods which have excellent cold drawing properties for attaining the first object of this invention produces wire rods which have a composite structure in which a low temperature transformation phase comprising a martensite, bainite and/or a mixed structure thereof which may partially contain retained austenite is finely dispersed in the ferrite phase. In the method steel materials containing, on a weight basis, C: less than 0.4 %, Si: less than 2% and Mn: less than 2.5%, are rolled into wire rods or wire rods are reheated followed by cooling. This sets the volume ratio of said low temperature transformation ratio to within a range from 10 to 95% and the average cooling rate in a temperature range from 550° to 200° C. is set to less than 40° C./sec upon cooling of the wire rods.

Explanation will at first be directed to the chemical compositions of this invention.

C has to be added in an amount of at least 0.02% in order to provide hot-rolled wire rods prepared from steel pieces with a predetermined composite structure and with a required strength. However, the upper limit for the added amount is 0.30%, since excess amounts will degrade the ductility of the low temperature transformation phase comprising martensite, bainite and/or a mixed structure thereof (hereinafter the secondary phase).

Si is effective as an element for reinforcing the ferrite phase but the upper limit for the added amount is set at 2.5%, preferably, 1.5% since added amounts in excess of 2.5% will substantially shift the transformation temperature toward the high temperature side and tend to cause decarbonization on the surface of the wire rods.

Mn is added to reinforce the wire rods, to improve the hardening property of the secondary phase and to make the configuration, preferably, acicular, but the upper limit for the added amount of Mn is set at 2.5 % since the effect will be saturated if it is added in excess of 2.5%. While on the other hand, since an insufficient added amount provides no substantial effect, Mn is added preferably in an amount no more than 0.3%.

In this invention, at least one or elements selected from Nb, V and Ti can be added further to make the metal structure of the wire rods finer. In order to make the structure finer, it is necessary to add additional elements in an amount of more than 0.005%. However, since the effect is saturated, if added in an excess amount, and it is economically disadvantageous as well, the upper limit is set to 0.2% for Nb and 0.3 % for V and Ti respectively.

Description will now be made for the elements inevitably or optimally contained in the wire rods in this invention.

S is preferably added in an amount of less than 0.005% in order to decrease the amount of MnS in the wire rod, by which the ductility of the wire rod can be improved. Further, the amount is preferably set to less than 0.003% in order to improve the hydrogen-resistant property.

P is added preferably in an amount such that the content is less than 0.01%, since it is an element which causes remarkable grain boundary segregation.

N is an element most likely to develop aging if present in a solid-solubilized state. Accordingly, it is added, preferably in an amount less than 0.004% and, particularly desirably, by less than 0.002% since it is aged during working thereby hindering the workability and, further, aged even after working which degrades the ductility of the ultra-fine wires obtained by the drawing.

Al forms oxide type inclusions which are less deformable and hence may hinder the workability of the wire rod, and further fractures tend to form starting from the inclusions during drawing of the wire rod. Accordingly, the Al content is usually less than 0.01% and, particularly preferably, less than 0.003%.

Further, if the Si/Al ratio in the wire rod is increased, the amount of silicate type inclusions is increased and, if the Al amount is smaller, the amount of the silicate type inclusions is increased particularly substantially to degrade the drawing property of the wire rod, as well as to degrade the fatigue property of the drawn wire obtained by drawing. Accordingly, the Si/Al ratio is set to less than 400 and, particularly preferably, less than 250 in this invention. Furthermore, the Si/Mn ratio is preferably set to less than 0.7 and, particularly desirably, less than 0.4 in this invention, because if the Si/Mn ratio exceeds 0.7, the composition and the configuration of the inclusions vary which results in degradation of the drawing property of the wire rod because of the dispersion and the distribution of the inclusions.

On the other hand, it is also desirable to adjust the configuration of the MnS inclusions by adding rare earth elements such as Ca and Ce.

Furthermore, solid-solubilized C and N can be fixed by adding Al including Nb, V and Ti as described above. Further, depending on the application of the ultra-fine wires according to this invention, it is also possible to properly add Cr, Cu and/or Mo in amounts less than 1.0% respectively, Ni less than 6%, Al and/or P less than 0.1% respectively and B less than 0.02 %.

In addition, it is essential for the wire rods of the invention that the (C+N) solid-solubilized in the ferrite phase be less than 40 ppm. That is, drawn wires having stabilized high ductility can be obtained according to this invention irrespective of the drawing speed by setting the weight of (C+N) solid-solubilized in the ferrited phase to less than 40 ppm. If the weight of (C+N) exceeds 40 ppm, the ductility of the drawn wire degrades and it becomes difficult to obtain high strength drawn wires with the tensile strength greater than 200 kgf/mm$^2$ as the working rate is increased.

As has been described above, since dehydrogenation or over aging is applied under a predetermined condition to the wire rod which has excellent cold drawing properties to suppress the (C+N) amount in the ferrite phase to less than a predetermined value according to this invention, the excellent drawing properties of the low carbon steel wire rods can be retained and, accordingly, highly ductile wire rods can be obtained irrespective of the drawing speed, which or course causes no breakage even during high speed drawing.

Particularly, drawn wires having a strength greater than 150 kgf/mm$^2$ and having high ductility can be obtained stably from the wire rod according to this invention at a drawing speed higher than 20 m/min and at a total reduction of area greater than 30%.

Explanation will be made for the structure of the wire rods according to this invention and the method or producing them.

This invention provides a method of producing wire rods having a composite structure in which a low temperature transformation phase comprising a martensite, bainite and/or mixed structure thereof that may partially contain retained austenite is uniformly dispersed in the ferrite phase by rolling steel materials having the chemical compositions as described above into wire rods or by heating them again followed by cooling, wherein the volume ratio of the low temperature transformation phase is set within a range from 10 to 95% and the average cooling rate in a temperature range from 550° to 200° C. is set to less than 40° C./sec upon cooling the above-mentioned wire rod.

At first, according to this invention, a wire rod having a composite structure in which a low temperature transformation phase comprising a martensite, bainite and/or mixed structure thereof, which may partially contain retained austenite, is uniformly dispersed in the ferrite phase and is obtained from steel pieces having the predetermined chemical compositions described above. The method of obtaining a wire rod having such a mixed structure is described in U.S. Pat. No. 4,578,124 as cited above.

Specifically, for making the secondary phase in the wire rod (low temperature transformation phase) into a fine acicular structure, heat treatment under a predetermined condition is applied to the hot-rolled wire rod having the predetermined composition as described above prior to heating to the temperature region Ac1-Ac3 thereby transforming the structure into a bainite, martensite and/or fine mixed structure thereof which may partially contain retained austenite and in which the grain size of the former austenite is less than 35 μm and, preferably, less than 20 micron (hereinafter sometimes referred to simply as a prestructure). By rendering the prestructure thus finer, the final structure can be made finer in order to improve the ductility and the toughness of the wire rod of the composite structure, thereby providing them with a desired strength.

For adjusting the grain size or the austenite to less than 35 μm, it is necessary to apply hot working to steel pieces obtained by ingotting or continuous casting at a reduction of area greater than 30% within a temperature range where the recrystallization or the grain growth of austenite proceeds extremely slowly, that is, within the temperature range lower than 980° C. and higher than Ac3 point, because austenite tends to recrystallize or cause grain growth if the hot working temperature exceeds 980° C. and it is impossible to make the grain size of the austenite finer if the reduction of area is lower than 30%. Furthermore, the temperature for the final working pass must be controlled to less than 900° C. in order to obtain fine austenite grains of about 10 to 20 μm, and it is necessary to maintain the final working step at a strain rate of greater than 300/sec in order to obtain ultra-fine grains of about 5–10 μm, in addition to the working conditions described above.

While it is also possible to obtain a desired configuration by applying cold working after the hot working as described above for controlling the grain size of the former austenite, the working rate for the cold work should be up to 40%. If a cold working greater than 40% is applied to the pre-structure, martensite recrystallizes upon heating to the temperature region Ac1-Ac3 as described later, failing to obtain a desired final structure.

The pre-structure or the bainite, martensite and/or the mixed structure thereof can be formed by the following methods.

In the first method, a desired prestructure is obtained during rolling, in which the steel piece is rolled under control or hot-rolled followed by accelerated cooling.

It is necessary to set the cooling rate to greater than 5° C./sec, because the usual ferrite-pearlite structure results if the cooling rate is lower than the above mentioned level.

In the second method of obtaining the prestructure, the rolled steel material is again applied with a heat treatment, in which steels are heated to the austenite region above the Ac3 point followed by controlled cooling. In this method, it is also desired to control the heating temperature to within the range of Ac3 - Ac3+100° C. in the same manner as referred to in the first method.

In this way, where the rolled steel materials in which the structure before heating to the region Ac1-Ac3 is a low temperature transformation phase comprising a martensite, bainite and/or mixed structure thereof, which may contain retained austenite, is heated to the region Ac1-Ac3 instead of the conventional ferrite-pearlite structure, a great amount of initial austenite grains forms around the retained austenite or cementite present at the lath boundary in the low temperature transformation phase as the preferred nuclei and they grow along this boundary.

Then, martensite or bainite transformed from the austenite is made acicular by cooling under a predetermined condition so as to be well-matched with the surrounding ferrite phase, by which the grains in the secondary phase are made much finer in comparison to the conventional ferrite pearlite pre-structure. Accordingly, it is important to determine the heating and cooling conditions to the Ac1-Ac3 region. That is, the secondary phase becomes bulky or bulky grains are mixed in the secondary phase depending on the conditions which impairs the intense workability.

More specifically, since the adverse transformation upon heating the prestructure comprising a fine bainite, martensite and/or mixed structure thereof to the austenite region is started by the formation of bulky austenite from the former austenite grain boundary and by the formation of acicular austenite within the grains up to about 20% of the austenite ratio, a structure in which the acicular and bulky low temperature transformation phase is dispersed in the ferrite is obtained by quenching from this state at a cooling rate, for example, greater than 150–200° C./sec. Accordingly, as the former austenite grains are finer, the bulky austenite is produced at a higher frequency. When the austenization further proceeds to greater than 40%, since the acicular austenite grains are joined with each other into bulky austenite, if they are quenched from this state, a mixed structure comprising ferrite and a coarse bulky low temperature transformation phase is formed. Further, if the austenization proceeds to greater than about 90%, since the bulky austenite gains are joined to each other and grow to complete the austenization, if they are quenched from this state, a structure mainly composed of a low temperature transformation phase is obtained.

In view of the above, upon heating the steel materials conditioned to the prestructure as described above to the region Ac1-Ac3 in this invention, a final metal structure is obtained, in which a fine low temperature transformation phase comprising an acicular bainite, martensite and/or mixed structure thereof which may partially contain the retained austenite is uniformly dispersed in the ferrite phase, by effecting the austenization to an austenizing rate of greater than about 20%, cooling from this state to an ambient temperature ~500° C. at an average cooling rate of from 40 to 150° C./sec, thereby separating ferrite and acicular austenite from the bulky austenite in the transformation process during cooling and transforming the acicular austenite into the low temperature transformation phase.

The average cooling rate is defined as described above, because if the cooling rate is lower than 40° C./see, polygonal ferrite is produced from the bulky austenite and the residual bulky austenite grains are transformed into the bulky secondary phase and, while on the other hand, if the cooling rate is higher than 150° C./sec, the bulky secondary phase is formed as described above. In this invention, the volume ratio of the secondary phase in the ferrite phase is within a range from 15 to 40%. When the volume ratio of the secondary phase lies within the range, the secondary phase grains are acicular and the average grain size thereof is less than 3 μm, whereby the thus obtained wire rods have excellent intense workability due to a characteristic composite structure not known in the prior art. On the other hand, if the volume ratio of the secondary phase is out of the above-range, the bulky secondary phase tends to mix into the final structure, even if the cooling is conducted under the conditions described above.

The cooling is stopped at a temperature from ambient temperature to 500° C., because the bainite, martensite and/or the mixed structure thereof, as the low temperature transformation phase can be obtained, as well as the thus formed secondary phase, can also be tempered by retarding the cooling rate or stopping the cooling within the above-mentioned temperature range.

For obtaining a desired composite structure, it is also possible to formulate such a structure during wire drawing in addition to the method of previously forming the composite structure before the wire drawing described above. That is, it is possible to use, as the wire rods, those having a composite structure in which a low temperature transformation phase comprising fine acicular martensite, bainite and/or mixed structure thereof is uniformly dispersed in the ferrite phase or those having a fine ferrite-pearlite structure, and to apply the steps of drawing such wire rods to intermediate wire rods of diameter from 3.5 to 0.5 mm, applying a heat treatment to the intermediate wire rods under a predetermined condition thereby obtaining intermediate wire rods of a composite structure in which a fine low temperature transformation phase comprising an acicular martensite, bainite and/or mixed structure thereof is uniformly dispersed in the ferrite phase, and then applying cold drawing to the intermediate wire rods of the composite structure by way of cold wire drawing into ultra-fine wires of a diameter ranging from 150 to 20 μm. The conditions for the heat treatment for producing the wire rod having the predetermined composite structure as described above and for producing the intermediate wire rod of the composite structure described above are substantially identical. However, it is necessary that the rod diameter be less than 3.5 mm in order to form the intermediate wire rod of composite structure in order to provide the intermediate wire rod with intense workability. On the other hand, the cost for the heat treatment increases in forming the composite structure, if the diameter of the intermediate wire rod is too small. Accordingly, the intermediate wire rod is prepared by drawing the starting wire rod into a diameter of from 0.5 to 3.5 mm in this invention. Particularly preferred diameter for the intermediate wire rod is within a range from 0.8 to 3.0 mm. The 0.8 mm diameter is the lower limit for the drawing work capable of drawing the ferrite-pearlite structure.

Then, the volume ratio of the low temperature transformation phase in the wire rod is set within a range from 10 to 70% and, preferably, from 20 to 50% in this invention. The strength of the obtained wire rod is poor if the volume ratio of the low temperature transformation phase is lower than 10%. On the other hand, if the ratio exceeds 70%, the workability is poor, although a material of high strength is obtained.

Further, in this invention, it is preferred that the ratio between the C content in the steels (wt %) the volume ratio of the low temperature transformation phase in the metal structure of the obtained wire rod is preferably less than 0.005. That is, it is desirable to define the lower limit for the amount of the secondary phase relative to the C content of the steels. If the value exceeds 0.005, the ductility of the secondary phase itself may be reduced. In the conventional method, no high strength wire rod can be obtained since the concentration of the C in the residual austenite accelerates during cooling after heating to the ferrite - austenite region and a hard secondary phase is uniformly dispersed therein in a small amount.

In the method of producing the high strength low carbon steel wire rods according to this invention, the average cooling rate within the temperature range from 550° to 200° C. during the cooling is set to less than 40° C./sec. If the average cooling rate exceeds 40° C./sec, dehydrogenation of the wire rod is insufficient, making it difficult to obtain wire rods which have excellent high speed wire drawing properties. The average cooling rate particularly preferred in view of the practical use usually ranges from 1° to 30° C./sec.

The method according to this invention as described above also employs a step in which the wire rod is maintained for a period of greater than 5 sec within a temperature range from 550° C. to 200° C. during cooling.

In the method according to this invention, it is, particularly, preferred that the low temperature transformation phase in the metal structure of the wire rod be of a fine acicular form and it should be uniformly dispersed and distributed in the ferrite phase. The wire rod having such a composite structure can be obtained, for example, by preparing a wire rod having the composite structure from the steel pieces having the chemical compositions described above, heating the wire rod to within the temperature region Ac1-Ac3 to accomplish austenization, cooling the thus obtained wire rod at an average cooling rate of 40° C./sec to obtain a wire rod having the composite structure, re-heating the wire rod for more than 5 sec within a temperature range from 200 to 600° C. and then applying an over aging treatment. A heating temperature outside the above-mentioned range is not suitable for the over aging treatment. Further, a treating time shorter than 5 sec has the drawback that the over aging treatment fails to result in the wire rod desired.

As has been described above according to this invention, since wire rods having excellent cold drawing property are dehydrogenated or subjected to an over aging treatment under a predetermined condition, excellent wire drawing properties can be retained therein and there is no cause for concern of breakage even upon high speed drawing, and ultra-fine steel wires of high strength and high ductility can be obtained by high speed drawing.

Thus, according to this invention, it is possible to produce high strength and highly ductile ultra-fine steel wires having a strength greater than 150 kgf/mm$^2$ and, preferably, greater than 200 kgf/mm$^2$ at a drawing speed higher than 20 m/min and at a total reduction of area greater than 30%.

The method of producing high strength and highly ductile ultra-fine wires for attaining the second object of this invention comprises cold drawing a wire rod having a composite structure, in which an acicular low temperature transformation phase comprising acicular martensite, bainite and/or mixed structure thereof, which comprises by weight %,

C: 0.01–0.30%

Si: 1.5%,

Mn: 0.3–2.5%, and the balance iron and inevitable impurities is uniformly dispersed in the ferrite phase at a volume ratio to the ferrite phase of 10 to 70% at a total reduction of area greater than 90%. Heat treatment is applied to the drawn wire during the course of wire drawing at a temperature lower than the recrystallizing point and, further, the wire is drawn.

According to the method of this invention, ultra-fine steel wires of improved strength are produced from wire rods of the composite structure in which a low temperature transformation phase having the chemical compositions described above and comprising an acicular martensite, bainite and/or mixed structure thereof is uniformly dispersed in the ferrite phase, by cold drawing the wire rod at a total reduction of area greater than 90%, wherein heat treatment is applied to the wire during drawing in the course of drawing at a temperature lower than the recrystallization point and further drawing the wire. Particularly, it provides a method of producing high strength and ductile ultra-fine steel wires with a strength greater than 300 kgf/mm$^2$ by applying cold wire drawing at a total reduction of area greater than 99%, wherein the heat treatment is applied to the drawn material in the course of the wire drawing at a temperature lower than the recrystallization point, while adjusting the strength of the drawn wire rod thereby preventing reduction in die life.

In the method according to this invention, the heat treatment as described above means heating the wire rod to such a temperature and time so as not to adversely affect the structural flow which forms with the ferrite-martensite two-phase extended in the working direction, and the heating temperature usually ranges from 200° to 700° C. and, preferably, from 300° to 600° C., depending on the heating time.

Generally, in the wire rods each of the phases in the structure is extended in the working direction by wire drawing to form a so-called structural flow. Further, dislocation microstructures form in each of the phases, and the strength of the drawn wire increases depending on these changes. In the method according to this invention, the microstructure is partially recovered and slight precipitation of elements such as C and N occurs in each of the phases by applying heat to cause structural flow to such an extent so as not to adversely affect the structural flow during drawing. Accordingly, upon further cold drawing the heat treated drawn wire, new dislocation microstructures form and develop around the precipitates present in the microstructures. While, on the other hand, since the structural flow develops on every drawing step subsequent to the previous wire drawing, the working limit for the wire rod is improved and, accordingly, the strength of the drawn wire can also be enhanced.

Accordingly, the minimum degree for wire drawing is defined as that which forms and develops the structural flow and the dislocation microstructures before heat treatment. Further, the minimum degree of wire drawing is defined after the heat treatment as that which forms and develops microstructures. In the study leading to the present invention, both of the minimum degrees of working described above are substantially from 50 to 80%. Further, since the strength after heat treatment and the work hardening ratio by the subsequent working change depending on the extent of recovery of the dislocation microstructures and the precipitation of elements such as C and N in the heat treatment, preferably the temperature and the time are optionally set for the heat treatment depending on the purpose.

A method of heating drawn wires worked to their working limit at a temperature higher than the recrystallization point thereby eliminating the worked structure and recovering the state before the working and then applying drawing work again is known. However, the heat treatment in this case is a so-called annealing, whereas the heat treatment in the method of the heat treatment involves heating the drawn wire to a temperature lower than the recrystallization point and, thus it is different from the conventional annealing treatment. If the temperature for heat treatment is higher than the recrystallization point in the method of the present invention, the strength of the wire after the heat treatment is reduced, by which the strength cannot be improved even if cold working is again subsequently applied and only the drawing work can be conducted. According to the method of this invention, the strength of the finally obtained ultra-fine steel wires can be improved or high strength and high ductility ultra-fine steel wires with a strength greater than 300 kgf/mm$^2$ can be produced while controlling the tensile strength upon manufacturing ultra-fine steel wires by applying intense working to wire rods having a predetermined composite structure, and then heat treating the wires to a temperature lower than the recrystallization point and subsequently cooling the wires during wire drawing.

Further, ultra-fine wires with a diameter less than 50 μm which have been difficult to produce by using conventional high carbon steel wire rods, even if parenting treatment and wire drawing are applied several times.

The method of producing ultra-fine steel wires for attaining the third object of this invention comprises a method of producing ultra-fine steel wires by continuously drawing cold wire to wire rods which have a composite structure, in which an acicular low temperature transformation phase mainly comprising an acicular martensite, bainite and/or mixed structure thereof which comprises

C: 0.01–0.30%,

Si: less than 2.0%,

Mn: 0.3–2.5%, and the balance iron and inevitable impurities is uniformly dispersed in the ferrite phase at a volume ratio from 10 to 70%. The rod is plated before or during the wire drawing step.

The brass-plated ultra-fine steel wires which are the third object of the present invention have a chemical composition comprising by weight %:

C: 0.01–0.30%,

Si: less than 2.0%,

Mn: 0.3–2.5%, and the balance iron and inevitable impurities and also contains a brass-plated layer comprising:

Cu: 40–65%,

Zn: 35–60%, and the balance being the inevitable impurities.

According to this invention, plated ultra-fine steel wires with high strength and high ductility can be obtained by plating the wire rod before or during wire drawing, and then continuously drawing the cold wire at a working rate greater than 90% and, preferably, greater than 98% thereby obtaining a preferred lubricating performance for the plated layer. Particularly, ultra-fine steel wires with high strength and high ductility that are not known in the prior art can be attained by cold wire drawing at a working rate greater than 98% when the volume ratio of the low temperature transformation product is set to 15–40% and the average grain size to less than 3 μm.

In this invention, the plating treatment is the deposition of highly ductile plated layers onto the wire rod by electrical plating, chemical plating, molten plating or the like. There is no particular restriction on the plating composition and the composition can include, for example, Cu, Cu alloys, Al and Al alloys. Further, plating deposits may be in the form of a single layer or plurality of layers, which can be homogenized subsequently.

In this invention, the composition of the brass plating lies within a range of Cu 40–70% and Zn 60–30%. In the conventional method of producing surface-plated ultra-fine steel wires by plating after the drawing of the wire rod, the composition for the brass-plating usually is Cu 60–70% and Zn 40–30%. It is believed that if Zn is used in a greater amount, the quality of the plated ultra-fine steel wires degrades because of the poor ductility of the plated layer. However, in the method of the present invention, if the Zn amount is increased to such a range as 40–65% Cu and 60–35% Zn, the plated layer exhibits a preferred lubricating effect for the wire drawing upon intense working utilizing the layer as a lubricant to ensure excellent continuous cold drawing properties while preventing the formation of an irregular layer on the surface of the drawn wire upon wire drawing, although the reason therefor has not yet been made clear at present. Further, the ductility of the thus obtained drawn wire is unexpectedly improved and, further, surface-plated ultra-fine steel wires having a uniform and homogenous plating layer can be obtained. Particularly, the surface brass-plated ultra-fine steel wires of the present invention in which the amount of Zn is increased have a remarkably improved close bondability with rubber in comparison to conventional surface-plated ultra-fine steel wires.

In this invention, the plating has to be deposited in such an amount as capable of obtaining a uniform plating thickness after the intense drawing work and, preferably, it is about from 1 to 15 g per 1 kg of the wire rod although the amount depends on the diameter of the ultra-fine steel wires. Particularly, for intense drawing of greater than 98%, the property of the plating layer itself, for example, uniform and homogenous properties can be improved very significantly by maintaining the amount of the plated layer within a range from 0.2 to 1.0% by weight based on the finally obtained ultra-fine steel wires.

In this invention, it is desirable to set the approaching angle of the drawing dies to 4°–15° in the drawing work of the wire rod after the plating and the approach angle is more desirably set to 4°–8° in the initial half of the wire drawing at a total working rate of about 80% after plating and a drawn wire strength of less than 120 kgf/mm$^2$. In this way, uniform working of the plated layer is facilitated and irregularity of the plated layer can be prevented.

Furthermore, by the method of the present invention, ultra-fine steel wires having a higher final strength can be obtained upon producing such wires by continuously drawing cold wire into wire rods of the composite structure described above at a total reduction rate of greater than 90%, by heat treating by heating the wire rods to a temperature lower than the recrystallization point during drawing and subsequently cooling the wires, since an increase in the strength relative to the reduction of area is greater in comparison to the case when no such heat treatment is applied.

In the case where molten plating is employed in the plating treatment for the method according to this invention, the heat treatment as described above can be carried out simultaneously by adjusting the plating composition to a desired melting point. That is, the plating bath can be utilized as the heating bath and/or cooling back in the heat treatment.

In the method of the present invention, the heat treatment as described above is the heating of the wire rods at such a temperature and within a time so that the structural flow formed with the ferrite and martensite phases extended in the working direction does not deteriorate and the heating temperature usually ranges from 200° to 700° C. and, preferably, from 300° to 600° C. depending on the heating time.

Generally, in the wire rods each of the phases in the structure extends in the working direction by the wire drawing to form a so-called structural flow. Also, dislocation microstructures form in each of the phases, and the strength of the drawn wire rod is increased because of these changes. In the method of the present invention, the microstructures is partially recovered and slight precipitation of elements such as C and N occurs in each of the phases by heating the wire rods to such an extent so as not to destroy the structural flow in the course of the drawing. Accordingly, upon further cold drawing the drawn wire subjected to such heat treatment, new microstructures are formed and develop around the precipitates present in the microstructures. While on the other hand, since the structural flow develops in every drawing step after the previous wire drawing step, the working limit for the wire rod is improved and, accordingly, the strength of the drawn wire rod can also be enhanced.

Accordingly, the minimum degree of wire drawing is defined as that which forms and develops the structural flow and the microstructures in the wire drawing before heat treatment, while the minimum degree of wire drawing is defined after the heat treatment as that which forms and develops new microstructures in the drawing work. According to the study of the present inventors, both of the minimum degrees of working as described above are substantially from 50 to 80%. Further, since the strength after the heat treatment and the work hardening ratio by the subsequent working change, depending on the extent of recovery of the dislocation microstructures and the precipitation of elements such as C and N in the heat treatment, it is preferred to optimally set the temperature and the time for the heat treatment depending on the purpose.

A method of heating the drawn wire which is worked to its working limit to a temperature higher than the recrystallization point is known, which eliminates the worked structure and recovers the state before the working and then the drawing work is applied again. However, the heat treatment in this case is a so-called annealing treatment, whereas the heat treatment in the method according to this invention is the heating of the wire to a temperature lower than the recrystallization point. This is different from the conventional annealing treatment. If the temperature for the heat treatment is higher than the recrystallization point in the method according to this invention, the strength after the heat treatment reduces, by which the strength cannot be improved even when subsequently cold working again and only the drawing work can be conducted.

Upon producing ultra-fine steel wires by intensely cold working wire rods having a predetermined composite structure, according to this invention, wire rods can be cold-drawn while desirably ensuring the cold drawing properties by plating the wire before or during wire drawing and utilizing the lubricating effect of the plated layer. Ultra-fine steel wires having uniformly and homogenously plated layers and having improved ductility can be obtained in this way. Further, the strength of the finally obtained ultra-fine steel wires can be improved by heat treating the wire by heating the wire to a temperature lower than the recrystallization point and subsequently cooling the wire during the wire drawing work.

Further, the surface brass-plated ultra-fine steel wires of this invention bond very well to rubber, since the brass-plating containing Zn in a greater amount than usual is made uniform and homogenized because of the intense work to the wire rods.

Furthermore, the strength of the finally obtained ultra-fine steel wires can be improved by heat treating to a temperature lower than the recrystallization point and subsequently cooling the wire during the course of the wire drawing step.

BRIEF DESCRIPTION OF THE DRAWINGS

These and other objects, as well as advantageous features of this invention will become apparent by reading the following descriptions for preferred embodiments of this invention in conjunction with accompanying drawings, wherein.

DETAILED DESCRIPTION OF THE PREFERRED EMBODIMENTS

This invention will now be explained specifically referring to examples.

EXAMPLE 1

Steels represented by reference R1 having a chemical composition as shown in Table 1 were rolled into a wire rod of 10 mm diameter and subjected to controlled cooling at an average cooling rate or 2° C./sec at a temperature within a range from 550° to 200° C. by a Stelmor cooling, thereby producing a wire rod of a composite structure in which martensite was uniformly dispersed in ferrite at a volume ratio of 16%. Further, steel represented by reference R2 were rolled into a wire rod of 5.5 mm diameter and directly hardened thereby producing a wire rod of a composite structure in which martensite was uniformly dispersed in ferrite at a volume ratio of 70%. Then, the thus obtained wire rods were subjected to over aging at 330° C. for 5 minutes. The results for the measurement of weight of solid solubilized (C+N) based on the internal friction in these wire rods are shown in Table 1.

Figure 1:
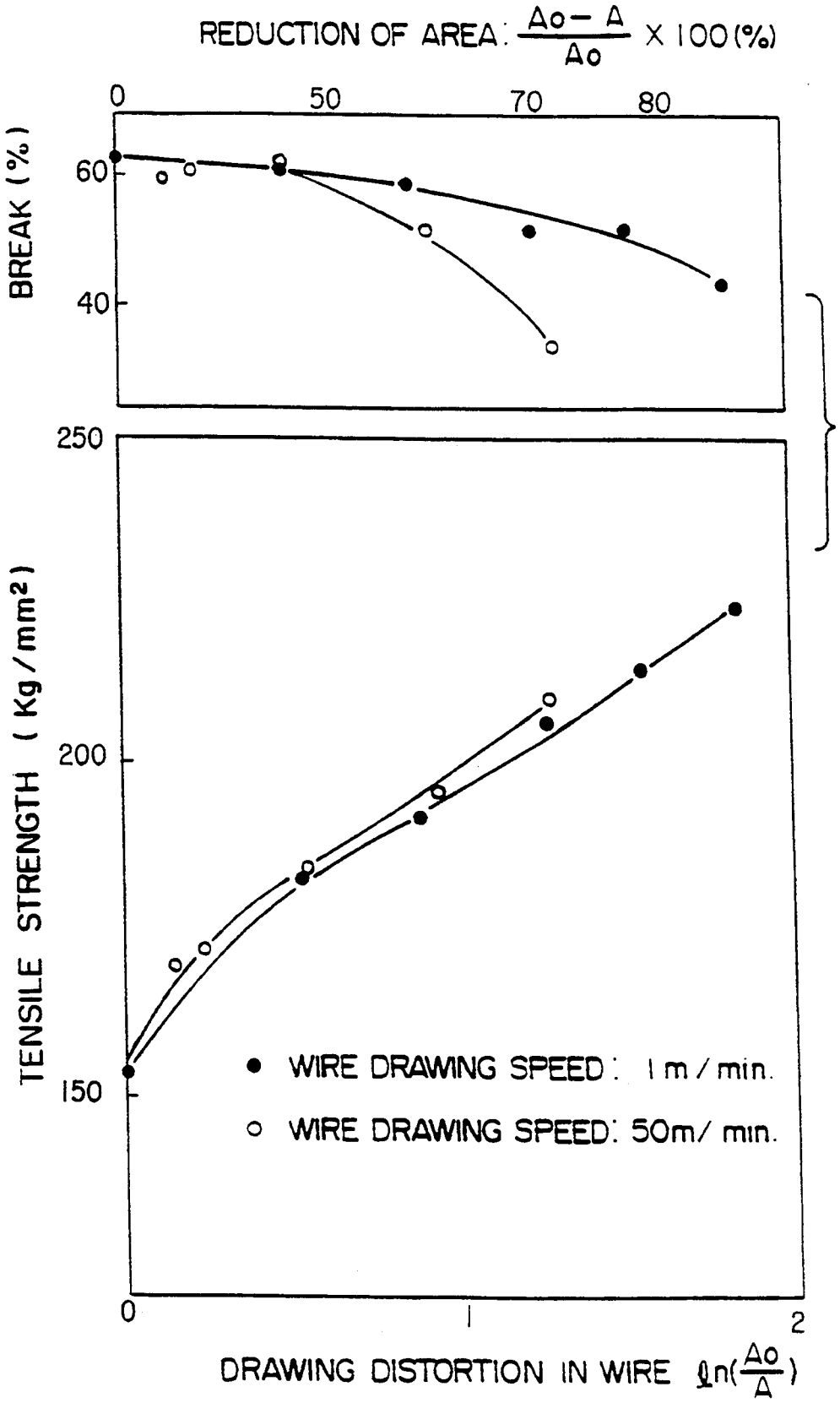
FIG. 1 is a graph showing the relationship between the drawing speed and the tensile strength and reduction of area at break in high strength wire rods comprising a composite structure having a low temperature transformation phase.
Figure 2:
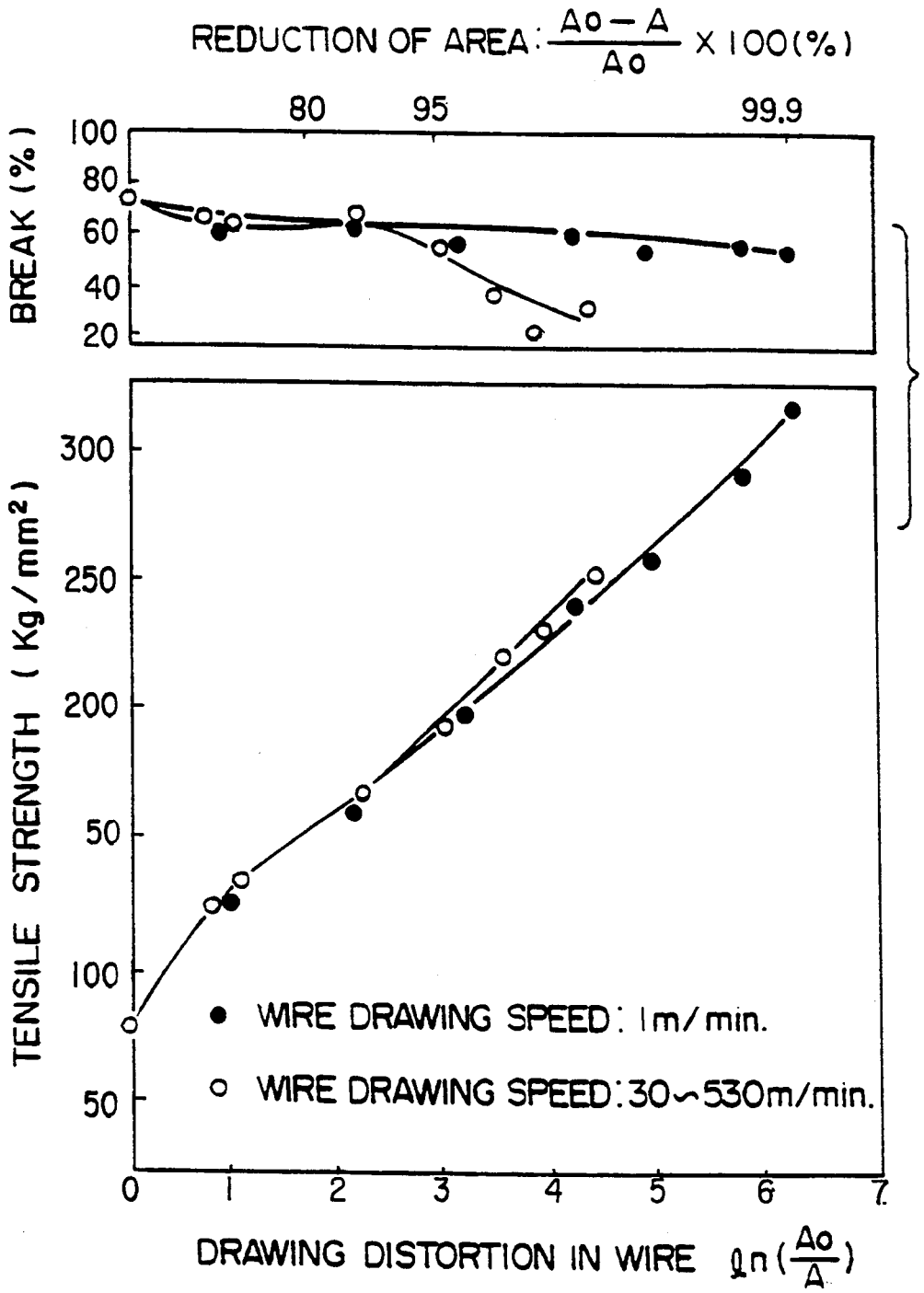
FIG. 2 is a graph showing the relationship between the drawing speed and the tensile strength and reduction of area at break in wire rods of high strength and high ductility comprised of a fine acicular low temperature transformation phase.
Figure 3:
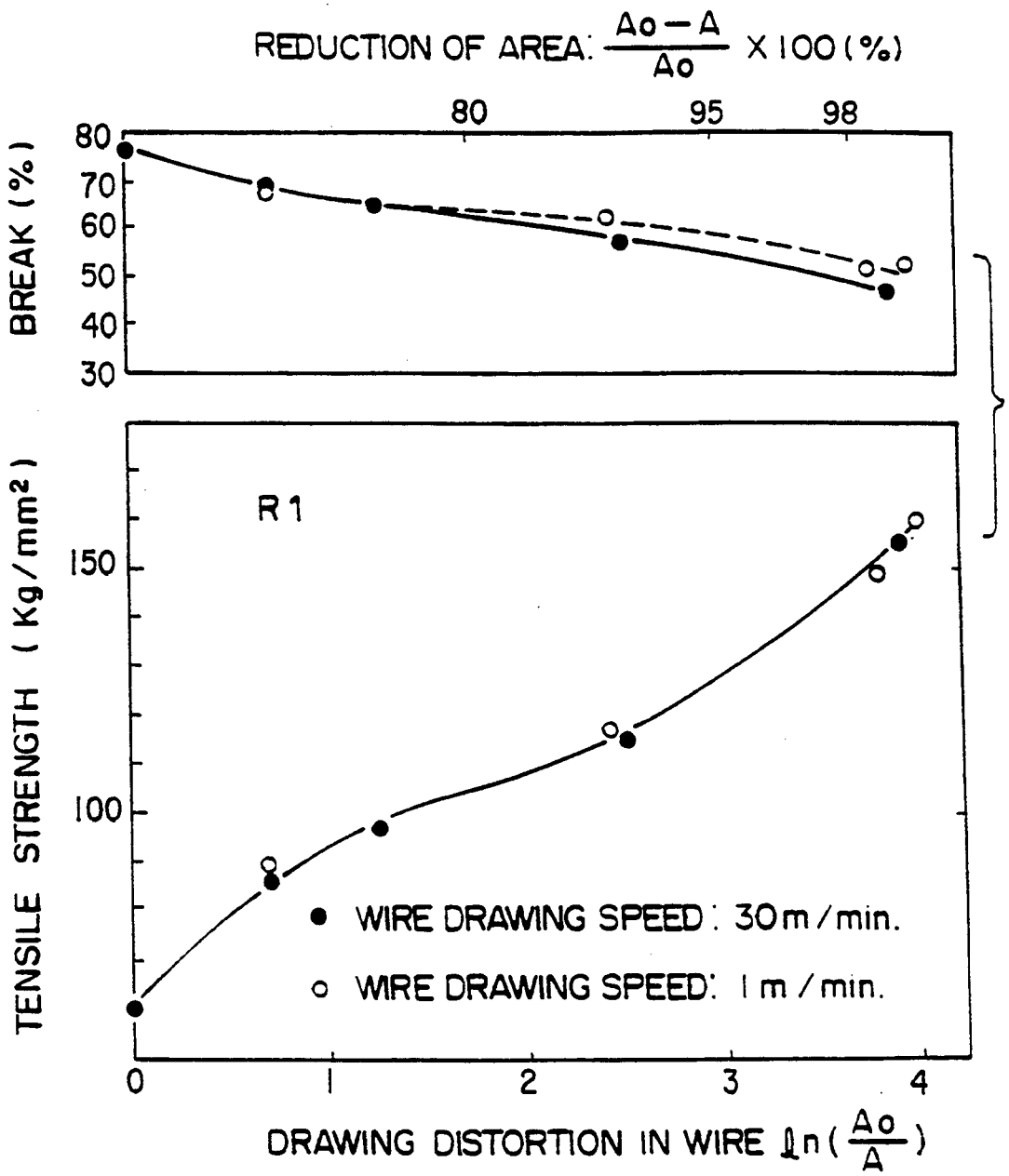
FIGS. 3 and 4 are graphs showing the drawing strain in the wire rod and the tensile strength and the reduction of area at break of the drawn wire obtained by the method according to this invention relative to different drawing speeds.
Figure 4:
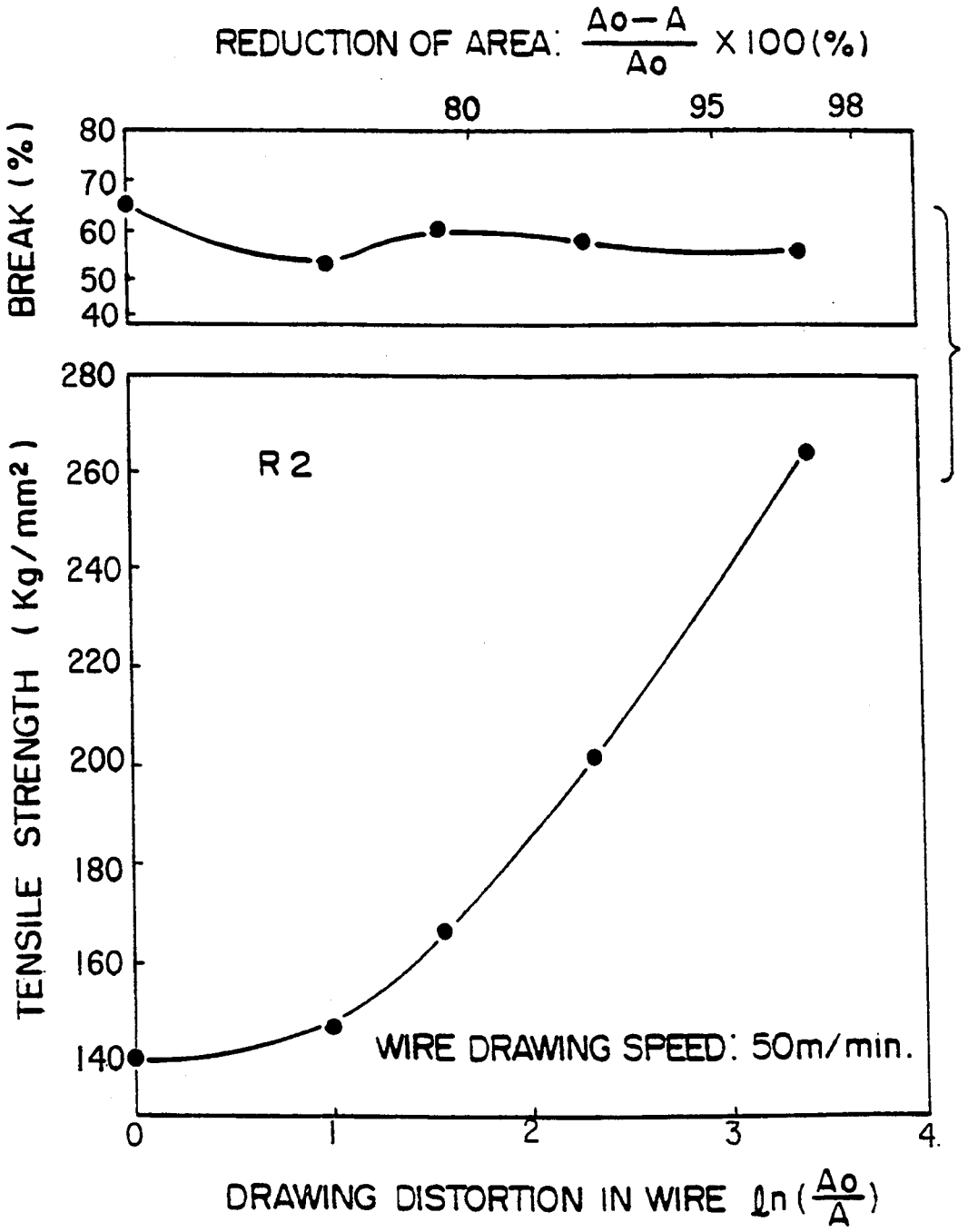

Each of the thus obtained wire rods was subjected to wire drawing after pickling and lubricating treatment. As shown by the results in FIG. 3, the wire rod corresponding to the steels R1 shows no degradation in the ductility of the drawn wire depending on the drawing rate. Further, as shown in FIG. 4, a high strength and high ductility drawn wire with a tensile strength of greater than 200 kgf/mm$^2$ could be produced by drawing the wire rod corresponding to steels R2 at a drawing rate or 50 m/min.

TABLE 1

| Reference for steels | Chemical Composition (wt %) C | Si | Mn | Al | N | S | Wire diameter (mm) | Low temp. transformation phase: volume ratio (%) | Solid solution (C + N) weight (ppm) | | Remarks |
|---|---|---|---|---|---|---|---|---|---|---|---|
| R1 | 0.06 | 0.15 | 1.72 | 0.031 | 0.003 | — | 10 | 16 | | 12 | Average cooling rate 2° C./sec over aging treatment at 330° C. for 5 min. |
| R2 | 0.15 | 0.22 | 1.56 | 0.026 | 0.004 | — | 5.5 | 70 | | 16 | |
| A | 0.07 | 0.46 | 1.48 | 0.003 | 0.003 | 0.002 | 5.5 | 20 | A1 | 103 | |
| | | | | | | | | | A2 | 24 | |
| B | 0.09 | 0.85 | 1.50 | 0.004 | 0.003 | 0.003 | 5.5 | 25 | B1 | 86 | |
| | | | | | | | | | B2 | 18 | |

TABLE 2

| Reference for steels | After heat treatment 7 hours | 115 hours | After pickling (HCl) 5 hours | 120 hours[1)] | Hydrogen sensitivity | |
|---|---|---|---|---|---|---|
| A1 | 72 | 78 | 76 | 76 | ordinary | Comparative Example (as water cooled) This invention (average coolong rate 25° C./sec)[2)] |
| A2 | 78 | 80 | 80 | 80 | small | |
| B1 | 55 | 63 | 55 | 57 | high | Comparative example (as water cooled) This invention (cooling stoped for 10 sec at 350° C.) |
| B2 | 62 | 69 | 68 | 70 | small | |

(Note)
[1)]drawing test applied
[2)]Average cooling range between 200–550° C.

EXAMPLE 2

Steels A and B having the chemical compositions shown in Table 1 were respectively rolled into wire rods of 5.5 mm diameter and directly hardened to form a structure mainly composed of martensite. Then, the wire rods were re-heated to the ferrite-austenite two phase region, followed by cooling into an acicular low temperature transformation phase. The volume ratio of the low temperature transformation phase was 20 % for the wire rod prepared from steels A and 25% for the wire rods prepared from steels B. The results of the measurement of the weight of the solid-solubilized (C+N) because of the internal friction in these wire rods are shown in Table. 1.

These wire rods A and B were re-heated followed by cooling. The wire rods obtained by cooling with water from the re-heated temperature of 800° C. are respectively referred to as comparative wire rods A1 and B1 (the average cooling rate within a range from 550° to 200° C. is 115° C./sec), while the wire rods obtained by controlled cooling from about 550° C. during the course of water cooling with respect to the wire rod A is referred to as wire rod A2 of the present invention (average cooling rate was 25° C./sec at a temperature from 550° to 200° C.). In the same way, the wire rod obtained by water cooling wire rod B from 800° C. and then interrupting the cooling for 10 sec at about 350° C. is referred to as wire rod B2 according to this invention.

The change in ductility as a result of aging after the heat treatment of the cold wire drawing for each of the wire rods was evaluated by the reduction of area at break (%), which is shown in Table 2. Degradation in the ductility with elapsed time after the heat treatment is substantial both in wire rods A1 and B1 as comparative wire rods and the degradation in ductility due to pickling was also remarkable. That is, it may be understood that these wire rods have high hydrogen sensitivity.

Figure 5:
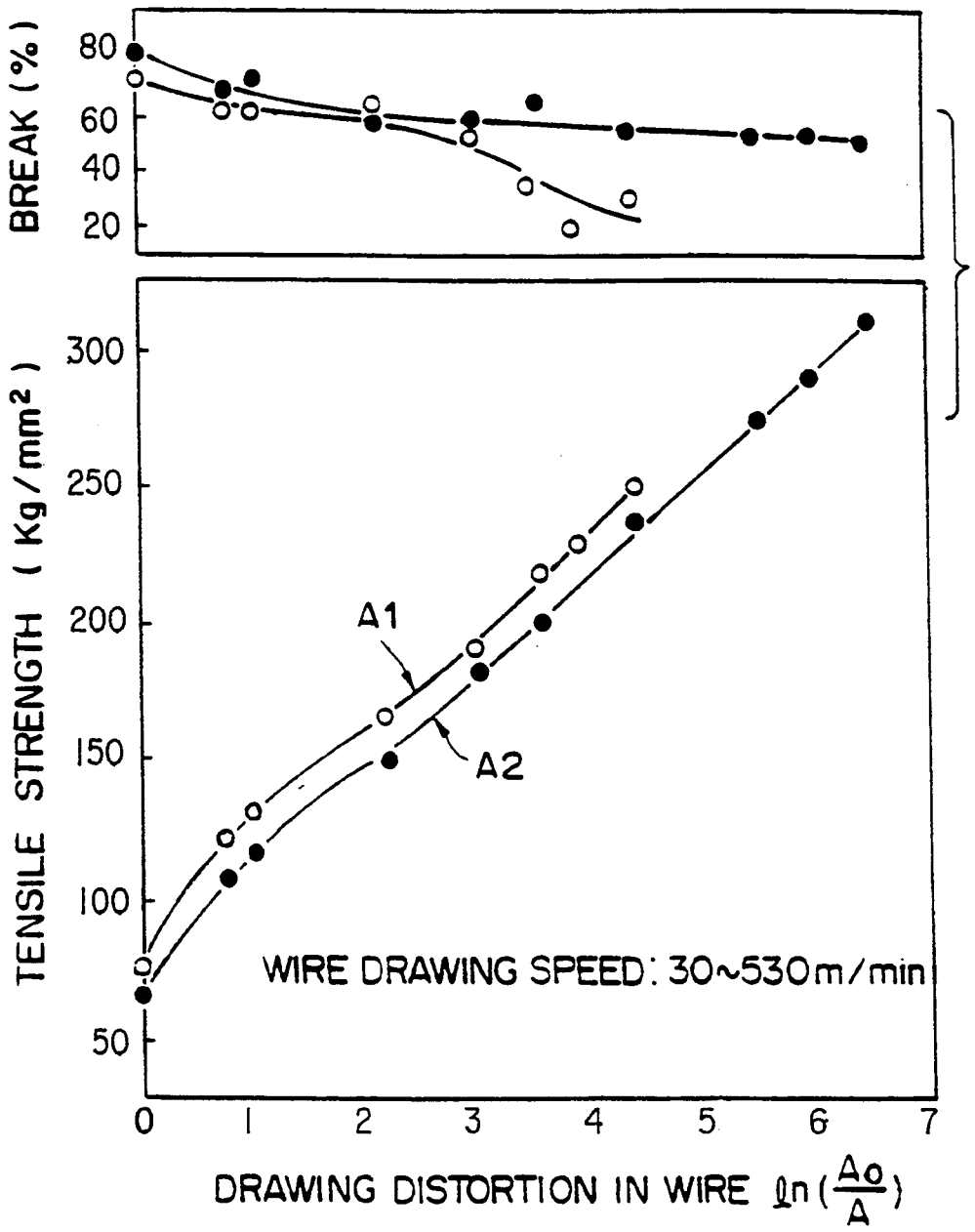
FIGS. 5 and 6 are graphs showing the drawing strain upon high speed drawing and the tensile strength and the reduction of area at break of the thus obtained drawn wire with respect to the drawn wire by the method according to this invention and the drawn wire of a comparative example.

Then, drawing results for the comparative wire rod A1 and the wire rod A2 of the invention are shown in FIG. 5. While both of the wire rods had excellent metal structures in the intense cold drawing properties, degradation in ductility was observed at a drawing strain greater than about 3 during the course of high speed drawing for A1. While on the other hand, wire drawing at a drawing strain greater than 6 was possible even under high speed drawing for A2 and high strength and high ductility drawn wires having a tensile strength or 250 kgf/mm$^2$ could be obtained.

Figure 6:
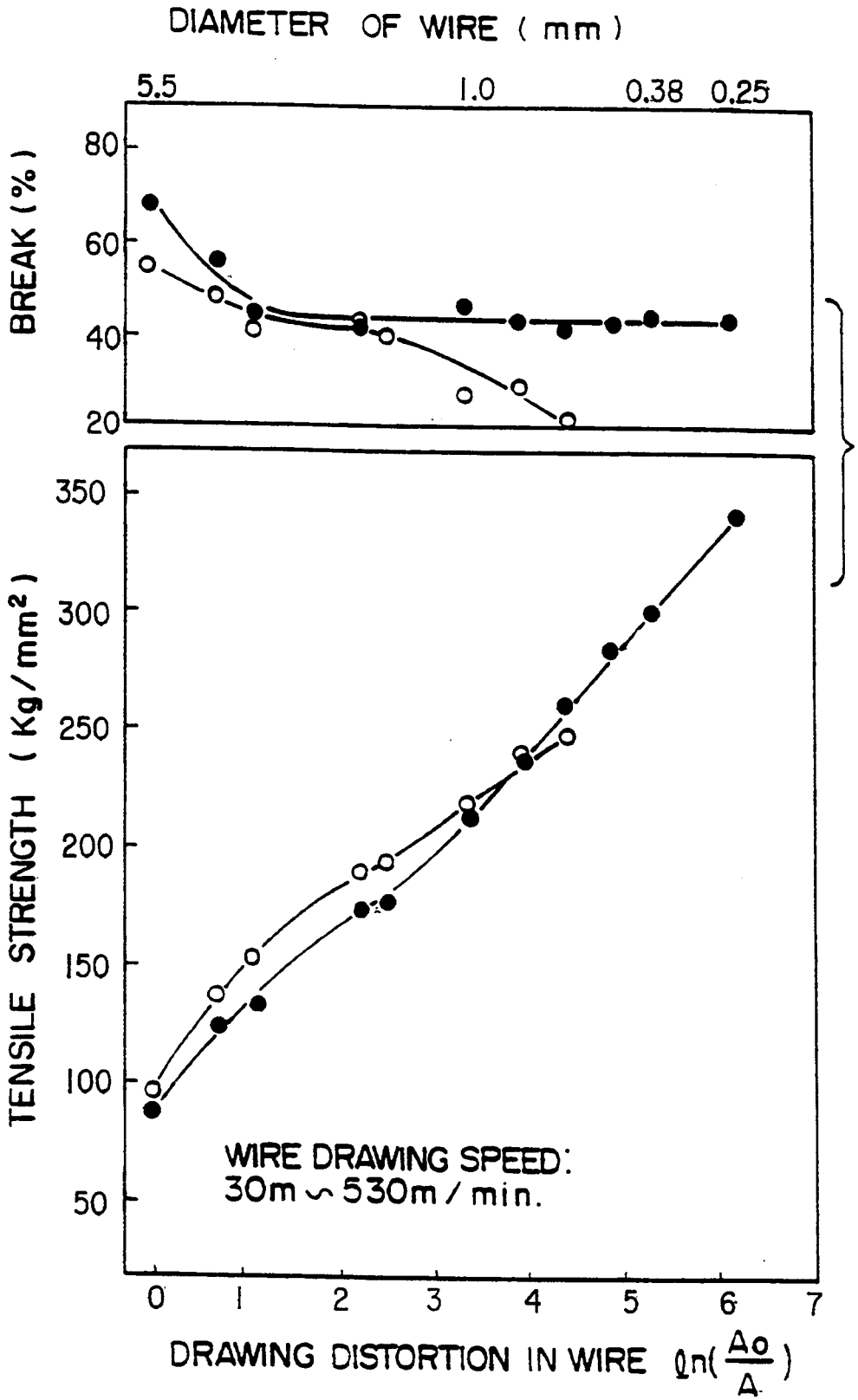

Further, although both of the comparative wire rods B1 and B2 of the invention had excellent metal structures in the intense cold drawing property, degradation in ductility resulted in wire rod B1 when water cooled in the course of the high speed drawing and high strength and high ductility drawn wire having a tensile strength of greater than 200 kgf/mm$^2$could not be obtained as shown in FIG. 6. In addition, the drawing work at a drawing strain of greater than 5 was difficult.

REFERENCE EXAMPLE 1

Production and properties of wire rods of composite structure

Steels A and B having chemical compositions defined in this invention as shown in Table 3 were rolled followed by water cooling to form fine martensite prestructures, which are respectively referred to as A1 and B1. As a comparison, steels A were rolled followed by air cooling to form a ferrite-pearlite prestructure, which is referred to as A2. The former austenite grain size was less than 20 μm in either case.

Figure 7:
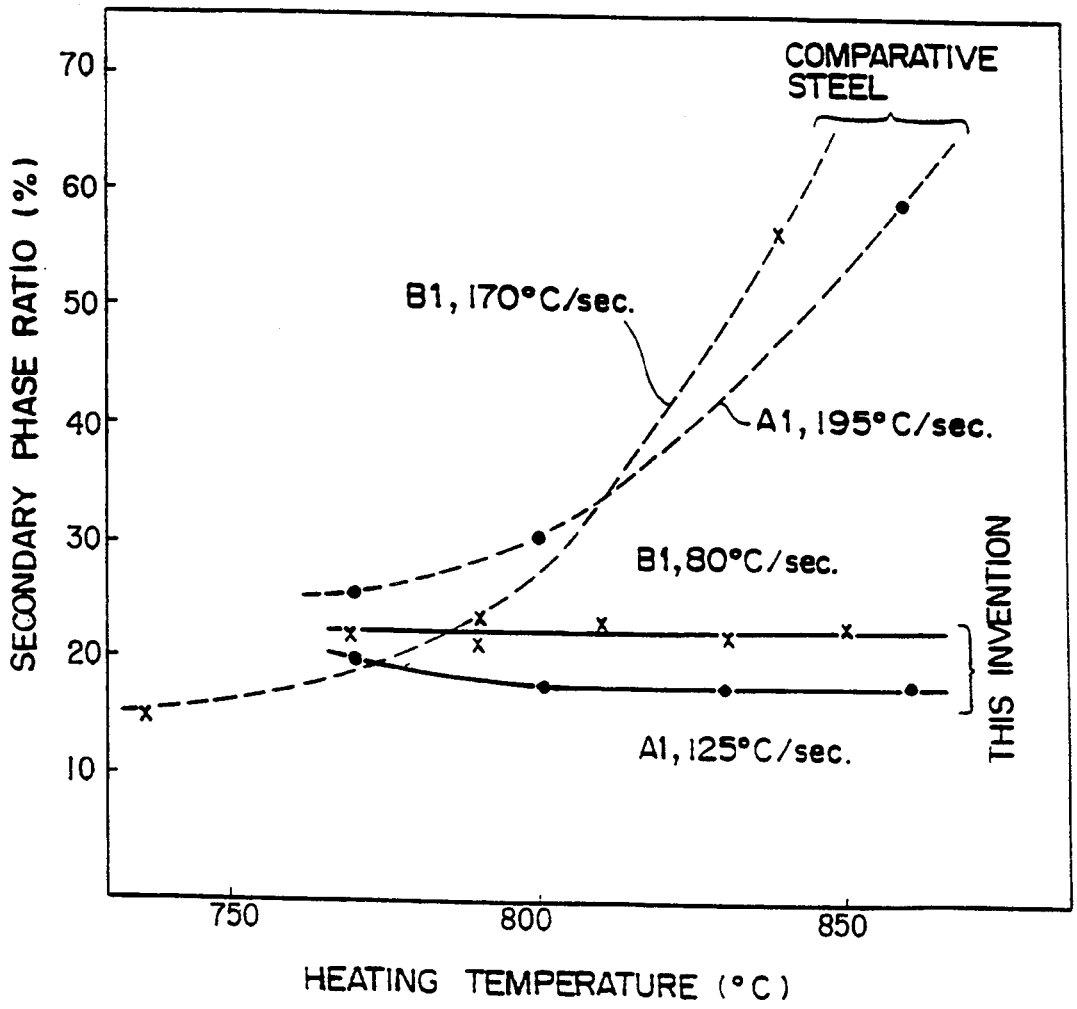
FIG. 7 is a graph showing the relationship of the configuration of the low temperature transformation phase and the volume ratio thereof in the ferrite phase, relative to the heating temperature and the average cooling rate when the steels having the composition as defined in this invention are heated to the Ac1 - Ac3 region, followed by cooling.

Then, A1 and B1 were heated and maintained for three minutes within the Ac1 - Ac3 region so as to have different austenizing ratio and they were cooled to a room temperature at various average cooling rates. FIG. 7 shows the configuration and the volume ratio of the grains in the secondary phase relative to the heating temperature and the cooling rate. The solid line represents a uniform mixed structure of ferrite and secondary acicular phase, while the broken line shows the mixed structure of ferrite, and secondary bulky phase, or a mixed structure of ferrite and acicular or bulky secondary phase.

TABLE 3

| Steel | Chemical Composition (wt %) | | | | | | | |
|---|---|---|---|---|---|---|---|---|
| Symbol | C | Si | Mn | P | S | Al | N | Nb |
| A | 0.09 | 0.79 | 1.36 | 0.020 | 0.018 | 0.007 | 0.0068 | — |
| B | 0.07 | 0.34 | 1.46 | 0.011 | 0.006 | 0.007 | 0.0044 | 0.022 |
| C | 0.07 | 0.49 | 1.47 | 0.001 | 0.0008 | 0.007 | 0.0018 | — |

When cooling at an average cooling rate of 125° C./sec or 80° C./sec, the configuration of the secondary phase of the rolled wire rod was acicular and the structure was composed of the secondary phase uniformly dispersed in the ferrite phase. The volume ratio of the secondary phase was substantially constant irrespective of the heating temperature. While on the other hand, if the average cooling rate was higher than 170° C./sec, the configuration of the secondary phase was bulky or a mixture of bulky and acicular grains and, the secondary phase ratio increased as the heating temperature became higher.

Figure 8:
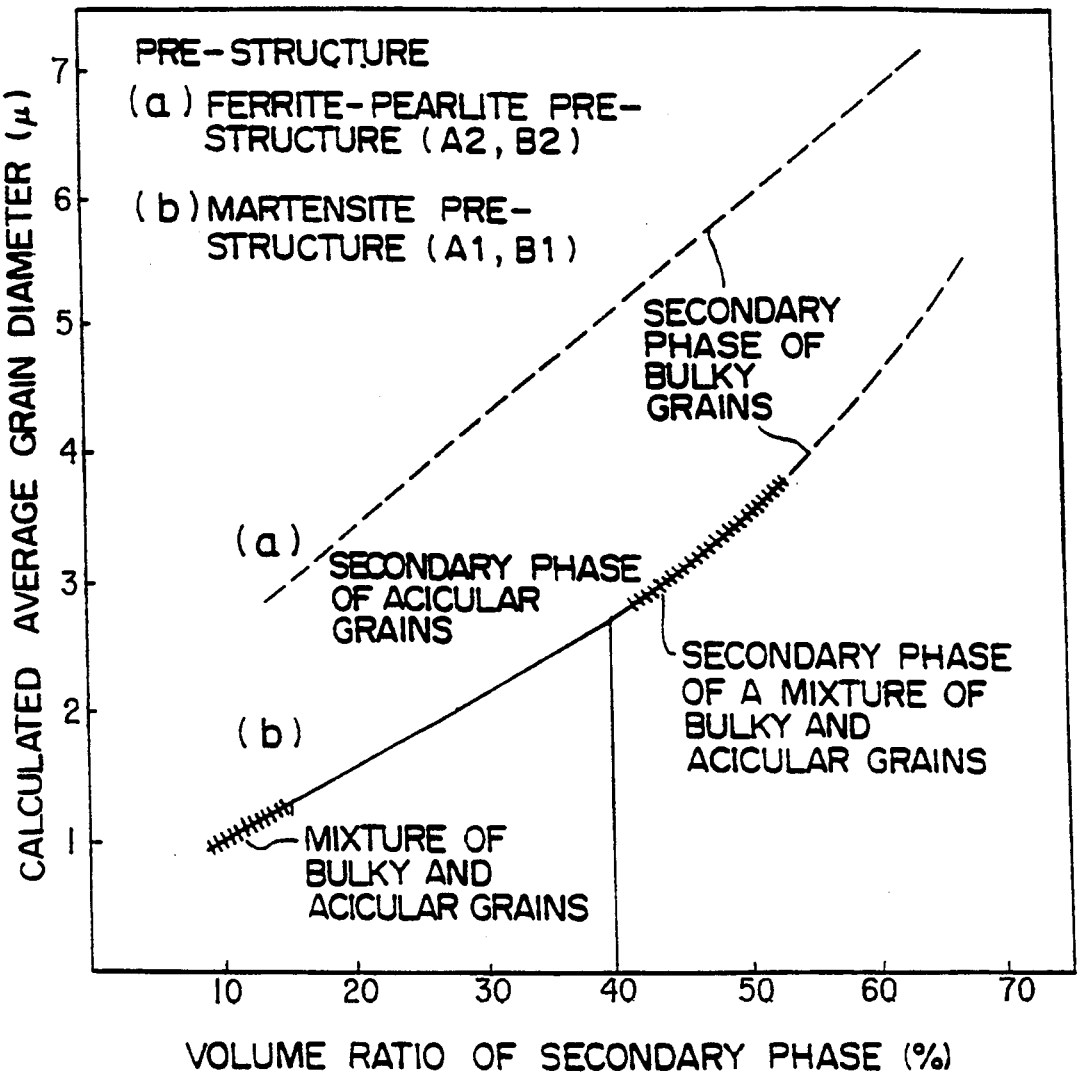
FIG. 8 is a graph showing the relationship between the volume ratio of the secondary phase and the configuration and average grain size in the secondary phase.

FIG. 8 shows the relationship between the volume ratio of the secondary phase and the calculated average grain size of the secondary phase grains present in the final structure with respect to steels A1 and B1 as the martensite pre-structure, as well as steels A2 and B2 as the ferrite-pearlite pre-structure respectively. In this case, the calculated average grain size means the average diameter when the area is converted into that of a circle for any of the configurations.

While the size of the secondary phase grains was enlarged along with an increase in the volume ratio of the secondary phase for any of the rolled wire rods, the size of the grains obtained from the martensite prestructure was much smaller in comparison to that obtained from the ferrite - pearlite prestructure for the identical secondary phase ratio. That is, even for the steel pieces having an identical composition, the size of the grains in the secondary phase could be made extremely finer by conditioning the pre-structure from the ferrite-pearlite to a martensite structure. Although the ductility in the rolled wire rods could significantly be improved by making the secondary phase grains finer, it did not always lead to improvement in intense workability. That is, when the secondary phase volume ratio was set to a range from 15 to 40%, the secondary phase became predominantly acicular, the secondary phase was composed of fine acicular grains with the calculated average grain size of less than 3 μm and further, the fine acicular secondary phase was uniformly dispersed and distributed into the ferrite phase, whereby excellent intense workability was attained. Of course, the foregoing situation is also applicable to the case where the secondary phase comprises acicular bainite, or the structure in admixture with martensite.

Table 4 shows the conditions for heating and cooling, the final structures and the mechanical properties for the rolled wire rods A1 and A2.

TABLE 4

| Steel No. | Reference for steel | Heating temperature (°C.) | Austenizing ratio (%) | Cooling rate (°C./sec) | Secondary phase in the final structure: Ratio (%) | Secondary phase in the final structure: Configuration[a] | Yielding strength (kg/mm²) |
|---|---|---|---|---|---|---|---|
| 1 | A1 | 800 | 33 | 17 | 13 | Δ | 35.1 |
| 2 | A1 | 760 | 16 | 125 | 11 | Δ | 46.2 |
| 3 | A1 | 850 | 56 | 125 | 21 | ○ | 38.8 |
| 4 | A1 | 800 | 33 | 125 | 18 | ○ | 38.5 |
| 5 | A1 | 830 | 38 | 125 | 17 | ○ | 39.1 |
| 6 | A1 | 860 | 66 | 125 | 18 | ○ | 37.9 |
| 7 | A1 | 900 | 100 | 125 | 68 | X | 85.9 |
| 8 | A1 | 800 | 33 | 195 | 36 | X | 61.5 |
| 9 | A1 | 860 | 66 | 195 | 59 | X | 75.2 |
| 10 | A2 | 830 | 35 | 17 | 14 | X | 34.8 |
| 11 | A2 | 860 | 60 | 125 | 41 | X | 45.0 |
| 12 | A2 | 860 | 60 | 195 | 56 | X | 77.6 |

| Steel No. | Tensile strength (kg/mm²) | Yielding ratio | Total[b] elentation (%) | Reduction (%) | Remarks |
|---|---|---|---|---|---|
| 1 | 58.7 | 0.60 | 32.5 | 70 | Comparative Example |
| 2 | 66.0 | 0.70 | 35.1 | 77 | Comparative Example |
| 3 | 75.8 | 0.52 | 35.2 | 68 | This invention |
| 4 | 77.0 | 0.50 | 34.2 | 71 | This invention |
| 5 | 76.1 | 0.51 | 34.0 | 74 | This invention |
| 6 | 76.4 | 0.50 | 35.1 | 73 | This invention |
| 7 | 100.3 | 0.86 | 16.9 | 56 | Comparative Example |
| 8 | 92.4 | 0.68 | 26.3 | 55 | Comparative Example |
| 9 | 103.7 | 0.72 | 21.8 | 61 | Comparative Example |
| 10 | 55.2 | 0.63 | 31.2 | 54 | Comparative Example |
| 11 | 79.6 | 0.58 | 24.3 | 68 | Comparative Example |
| 12 | 96.0 | 0.81 | 13.5 | 53 | Comparative Example |

(note)
[a]O: Uniform structure in which acicular martensite is mixed and dispersed in ferrite (steel of the invention)
X: Mixed structure of ferrite and bulky martensite (Comparative Steel)
Δ: Mixed structure of ferrite and bulky and acicular martensite (Comparative Steel)
[b]Gage length = 5.64 √ area of cross section (mm)

It is apparent that the wire rods represented by steel Nos 3, 4, 5 and 6 prepared by heating the wire rod A1 in which the pre-structure comprises fine martensite to the Ac1- Ac3 region such that the austenizing ratio is more than 20%, followed by cooling at 125° c/sec have a composite structure in which fine acicular martensite (secondary phase) is uniformly mixed and dispersed in the ferrite phase at a volume ratio in a range from 15 to 40% and exhibit an outstanding balance between the strength and the ductility.

While on the other hand, the rolled wire rod A2 having the ferrite-pearlite prestructure formed the steels Nos. 10, 11 or 12, in which the secondary phase was in a bulky form irrespective of the heating and cooling conditions, any of which was poor in the balance between strength and ductility. While on the other hand, even if the pre-structure was composed of martensite, steels Nos. 1 and 2 had a fine mixture of ferrite and bulky and acicular martensite, since the cooling rate after heating to the Ac1 - Ac3 region was too low for the steels No. 1 and since the austenizing ratio upon heating to the Ac1 -Ac3 region is 16% for the steels No. 2 and, accordingly, they were inferior to the steel materials according to this invention although excellent over the steels Nos. 10–12 described above with respect to balance between strength and ductility.

Then, wire rods of 6.4 mm diameter having different secondary phase configurations are subjected to intense cold drawing. Table 5 shows the properties after the drawing work. From the wire rod of steel No. 1, a wire rod of 2 mm diameter with a tensile strength of 90 kgf/mm² and reduction of area at break of 58% can be obtained at a working rate of 90%, while a wire rod of 0.7 mm diameter of a higher strength could be obtained at a working rate of 98%. While on the other hand, for the comparative steel wire rod of steel number 2 having a bulky secondary phase, the ductility rapidly degrades with an increase in the working rate and breakage occurs at a working rate of about 90%. The comparative wire rod of steel No. 3 had a structure finer than that of steel No. 2 and although it was excellent in comparison to steel No. 2 in view of its intense workability, the degradation in the property after the working was substantial in comparison with that of the steel No. 1.

Then, as shown in Table 3, steels B and C having the chemical compositions as defined in this invention were formed into wire rods of 5.5 mm diameter having a uniform fine composite structure comprising ferrite and acicular martensite according to this invention, which are referred to as B1 and C1 respectively. Table 6 shows the mechanical properties of wire rods B1 and C1 and the mechanical properties of drawn wire material worked into ultra-fine steel wires of a diameter less than 1.0 mm.

TABLE 5

| Steel No. | Steel symbol | Wire diameter (mm) | Wire diameter drawn work rate (%) | Tensile strength (kg/mm²) | Reduction (%) | Configuration for two phase[a] | Remark |
|---|---|---|---|---|---|---|---|
| 1 | A1 | 6.4 | 0 | 76 | 74 | ○ | Wire rod of the invention |
| | | 4.0 | 61 | 120 | 67 | | |
| | | 3.0 | 78 | 141 | 66 | | |
| | | 2.0 | 90 | 170 | 58 | | |
| | | 1.5 | 95 | 182 | 55 | | |
| | | 1.0 | 98 | 221 | 53 | | |
| | | 0.7 | 99 | 248 | 49 | | |
| 2 | A2 | 6.4 | 0 | 73 | 62 | X | Comparative steel wire rod |
| | | 4.0 | 61 | 104 | 41 | | |
| | | 3.0 | 78 | 124 | 33 | | |
| | | 2.0[b] | 90 | 148 | 11 | | |
| 3 | A1 | 6.4 | 0 | 84 | 66 | Δ | Comparative steel wire rod |
| | | 4.0 | 61 | 123 | 54 | | |
| | | 3.0 | 78 | 140 | 45 | | |
| | | 2.0 | 90 | 169 | 31 | | |

(note)
[a]Same to Table 4
[b]disconnected during drawing

Both of the wire rods B1 and C1 had high ductility and could be intensely worked at 99.9% rate, and the thus obtained wire rods also had high strength and high ductility. Table 4 also shows the mechanical properties of wire rod C1 after drawing at a working rate of 97% into a drawn wire (0.95 mm diameter) and then annealed at a low temperature from 300° to 400° C. It is apparent that the ductility of the wire rods was improved as a result of annealing at low temperature. Reduction in strength is not recognized. Accordingly, the ductility of the wire material can be improved by an annealing heat treatment at low temperature and, further, the ductility of the obtained drawn wire can further be improved by combining the annealing at low temperature with the step in the course of the drawing of the wire material.

TABLE 7

| Reference for steel | Chemical ingredient (wt. %) | | | | | | Secondary phase | |
|---|---|---|---|---|---|---|---|---|
| | C | Si | Mn | Ti | Al | S | ratio (%) | grain size (μ) |
| A | 0.068 | 0.50 | 1.50 | — | 0.003 | — | 21 | 1.5 |
| B | 0.074 | 0.50 | 1.49 | 0.022 | 0.003 | — | 20 | 1.4 |
| C | 0.08 | 0.55 | 1.50 | — | 0.002 | 0.003 | 23 | 1.7 |

EXAMPLE 3

Production of ultra-fine steel wires

Steel pieces A and B having the chemical compositions shown in Table 7 were hot rolled into wire rods of 5.5 mm diameter, rolled and then cooled with water. The rolled wire rods were heated to 810° C., cooled in water into martensite and thereby formed into wire rods A and B having a mixed structure of the secondary phase mainly composed of martensite and ferrite.

Wire rod A was subjected to pickling and brass-plating, then drawn down to 0.96 mm diameter, subjected

TABLE 6

| Steel No. | Steel Symbol | Wire diameter (mm) | Wire diameter drawn work rate (%) | Tensile strength (kg/mm²) | Reduction (%) | Treating condition |
|---|---|---|---|---|---|---|
| 1 | B1 | 5.5 | 0 | 69 | 76 | heat treatment after cooling[a] |
| | | 1.0 | 96.7 | 191 | 55 | after drawing |
| | | 0.8 | 97.9 | 204 | 53 | |
| | | 0.5 | 99.2 | 228 | 50 | |
| | | 0.38 | 99.5 | 243 | 46 | |
| | | 0.25 | 99.8 | 271 | 44 | |
| | | 0.20 | 99.9 | 297 | 41 | |
| 2 | C1 | 5.5 | 0 | 68 | 82 | heat treatment after cooling[b] |
| | | 0.95 | 97.0 | 200 | 52 | after drawing |
| | | 0.95 | 97.0 | 204 | 62 | after annealing at[c] 350° C. × 3 sec |
| | | 0.95 | 97.0 | 200 | 56 | after annealing at[c] 400° C. × 3 sec |
| | | 0.95 | 97.0 | 207 | 64 | after annealing at[d] 300° C. × 10 min. |

(Note)
[a]After heating at 800° C. for 3 min, cooled at 80° C./sec to room temperature
[b]After heating at 800° C. for 2 min, cooled at 125° C./sec to room temperature
[c]Heat treatment in salt bath
[d]Heat treatment in electrical furnace to heat treatment to a predetermined temperature and further drawn to a diameter of 0.30 mm.

For a comparison, wire rod A was subjected to pickling and brass-plating, and then drawn down to 0.30 mm diameter without applying a heat treatment during the course of the wire drawing.

Figure 9:
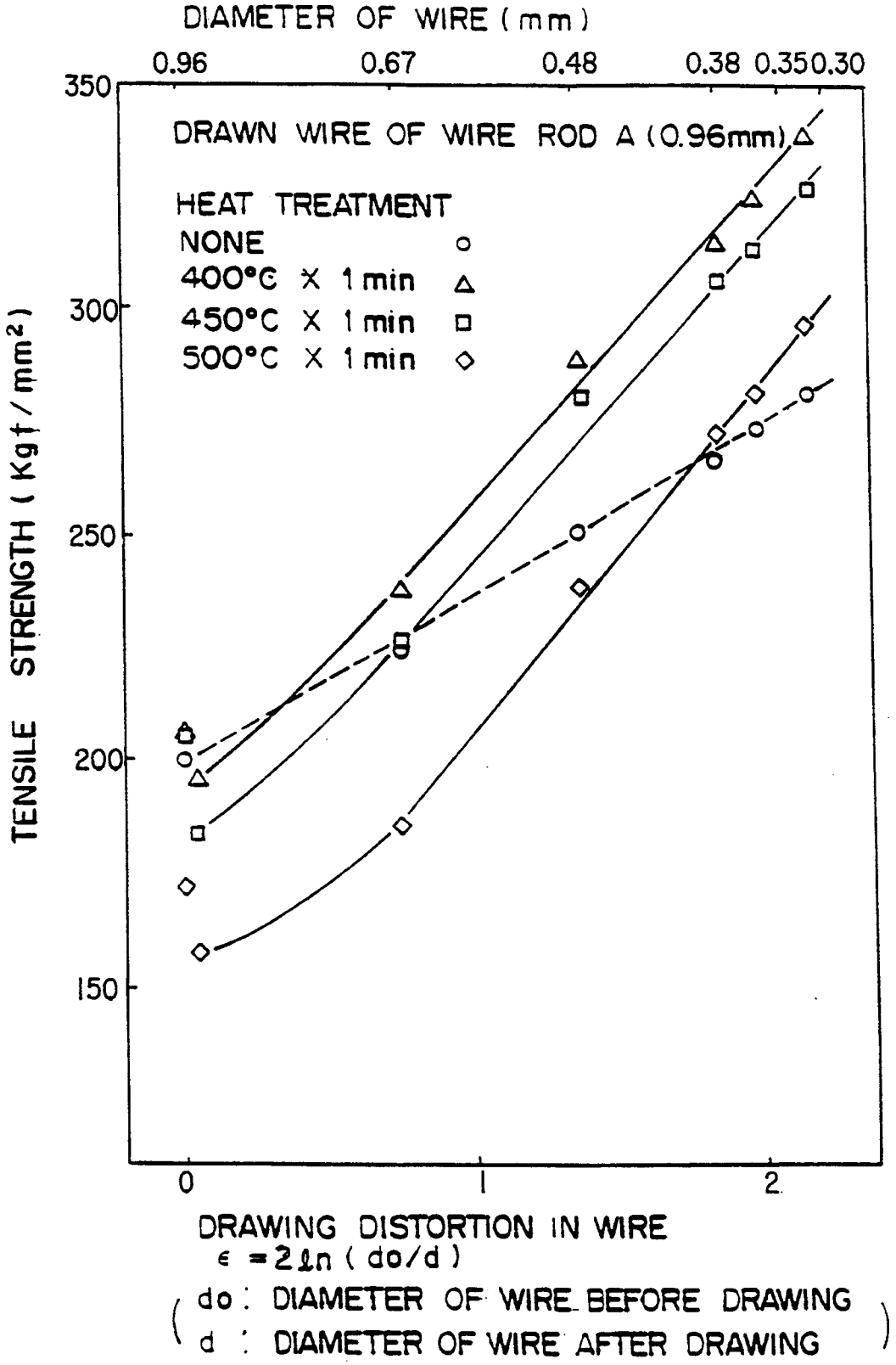
FIG. 9 is a graph showing the relationship among the drawing strain, temperature for the heat treatment and the tensile strength for the drawn wire thus obtained when the wire rod of a composite structure is heat treated in accordance with the method of this invention.
Figure 10:
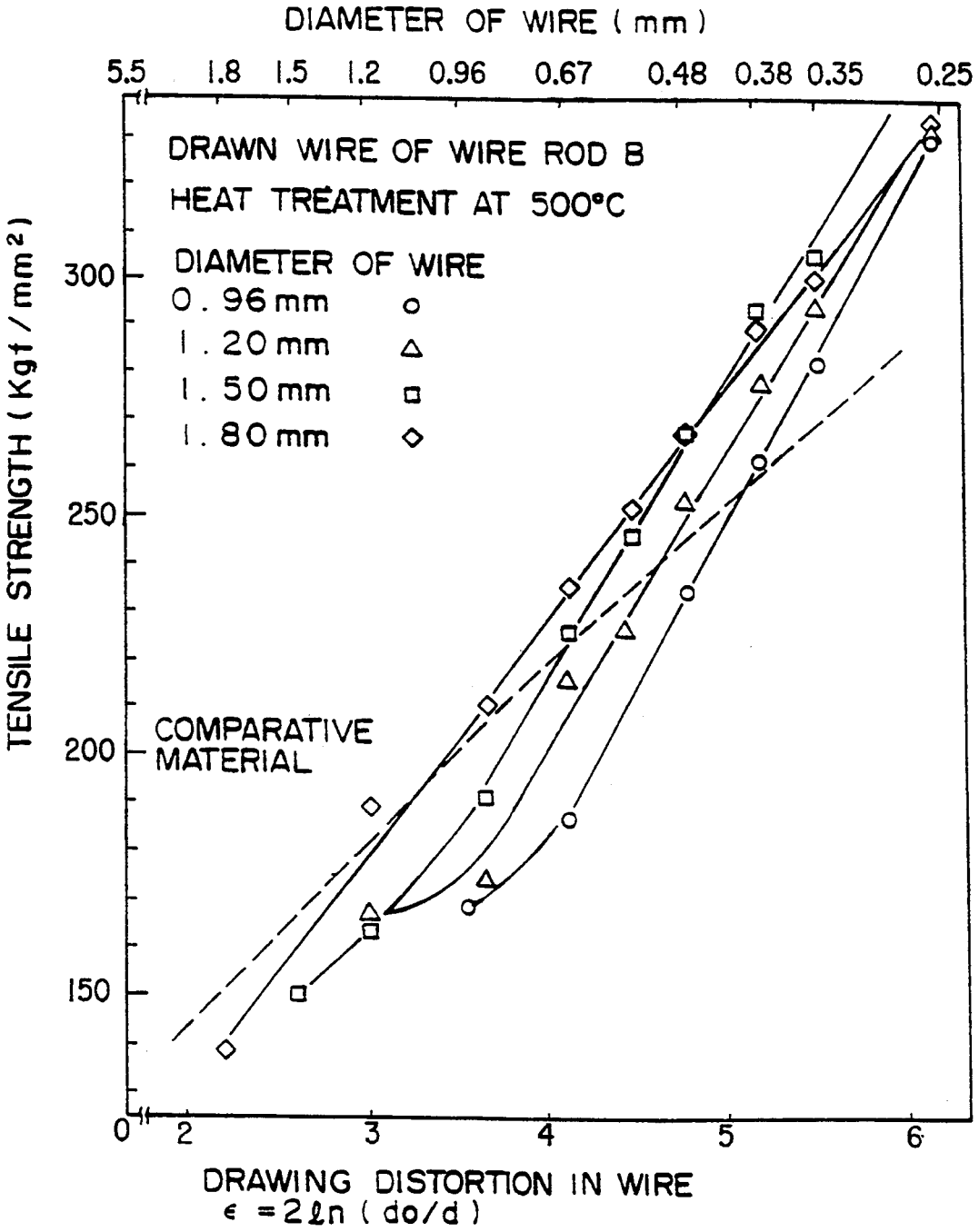
FIG. 10 is a graph showing the relationship among the drawing strain, the diameter of the intermediate drawn wire and the tensile strength of the thus obtained drawn wire when the wire rod of the composite structure of a predetermined diameter is heat-treated in accordance with the method of this invention.

FIG. 9 shows the drawing strain after the heat treatment and tensile strength of the obtained ultra-fine steel wires. It is apparent that the strength remarkably increased as a result of drawing after the heat treatment.

Next, the wire rod B was subjected to pickling and lubrication, then drawn into diameters of 0.96 mm, 1.20 mm, 1.50 mm and 1.80 mm, subjected to brass-plating respectively, and then subjected to a heat treatment at a temperature of 500° C. for one minute, followed by cooling and then further drawn respectively into ultra-fine steel wires of 0.25 mm diameter. As a comparison, the result of drawing the wire rod B of 5.5 mm diameter with no heat treatment is shown by the dotted line. The work hardening rate was apparently increased by the heat treatment and, according to the method of this invention, the strength of the ultra-fine steel wires was significantly improved by about 50 kgf/mm$^2$.

Figure 11:
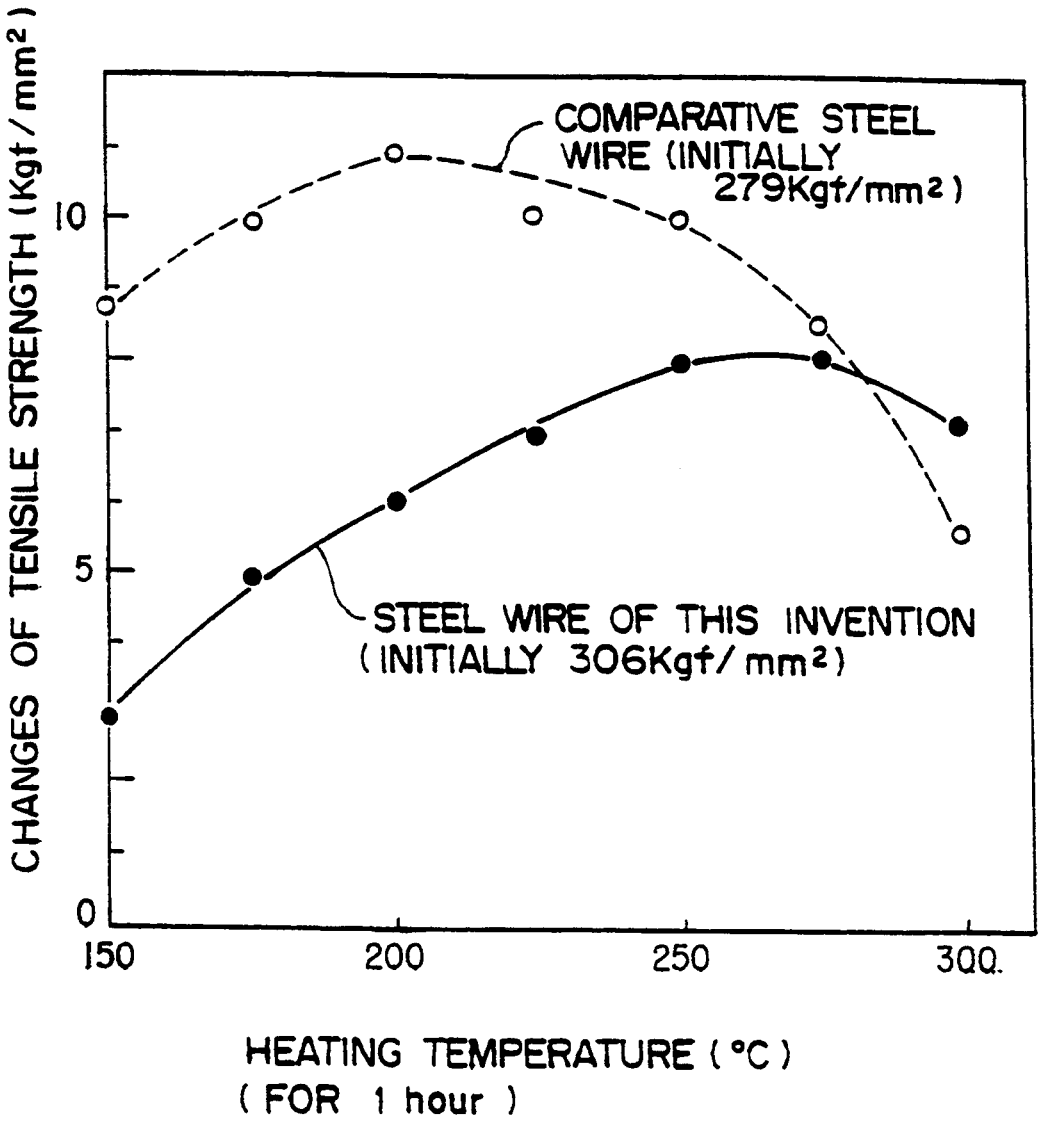
FIG. 11 is a graph showing the heat resistance of the ultra-fine steel wires according to this invention.

FIG. 11 shows the heat resistance of ultra-fine steel wires of 0.25 mm diameter which were the final drawn wire material obtained as described above, and the reduction in the strength due to the temperature was low in the steel wires according to this invention. While on the other hand, the reduction in the strength was remarkable in the comparative steel wires described above.

EXAMPLE 4

Production of ultra-fine steel wires

Steels C having the chemical compositions shown in Table 7 were hot rolled into a wire rod of 5.5 mm diameter, and then rolled followed by cooling in oil. The rolled wire rod was heated to 810° C., cooled with water into martensite thereby produce a wire rod having a mixed structure comprising a secondary phase mainly composed of martensite and ferrite as shown in Table 7.

Figure 12:
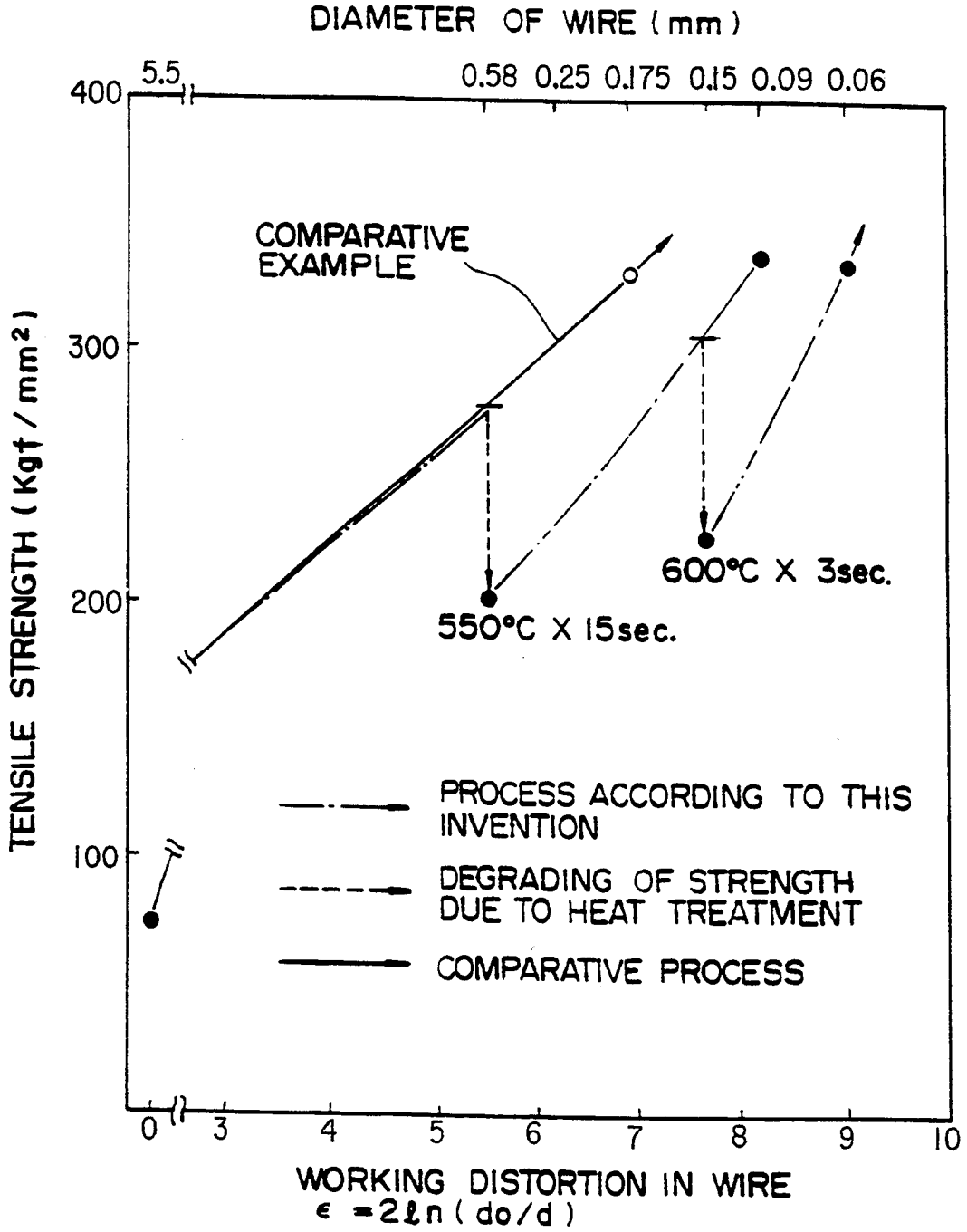
FIG. 12 is a graph showing the relationship between the drawing strain and the tensile strength of the drawn wire rod upon drawing the wire rod of the composite structure by the method according to this invention.
Figure 13:
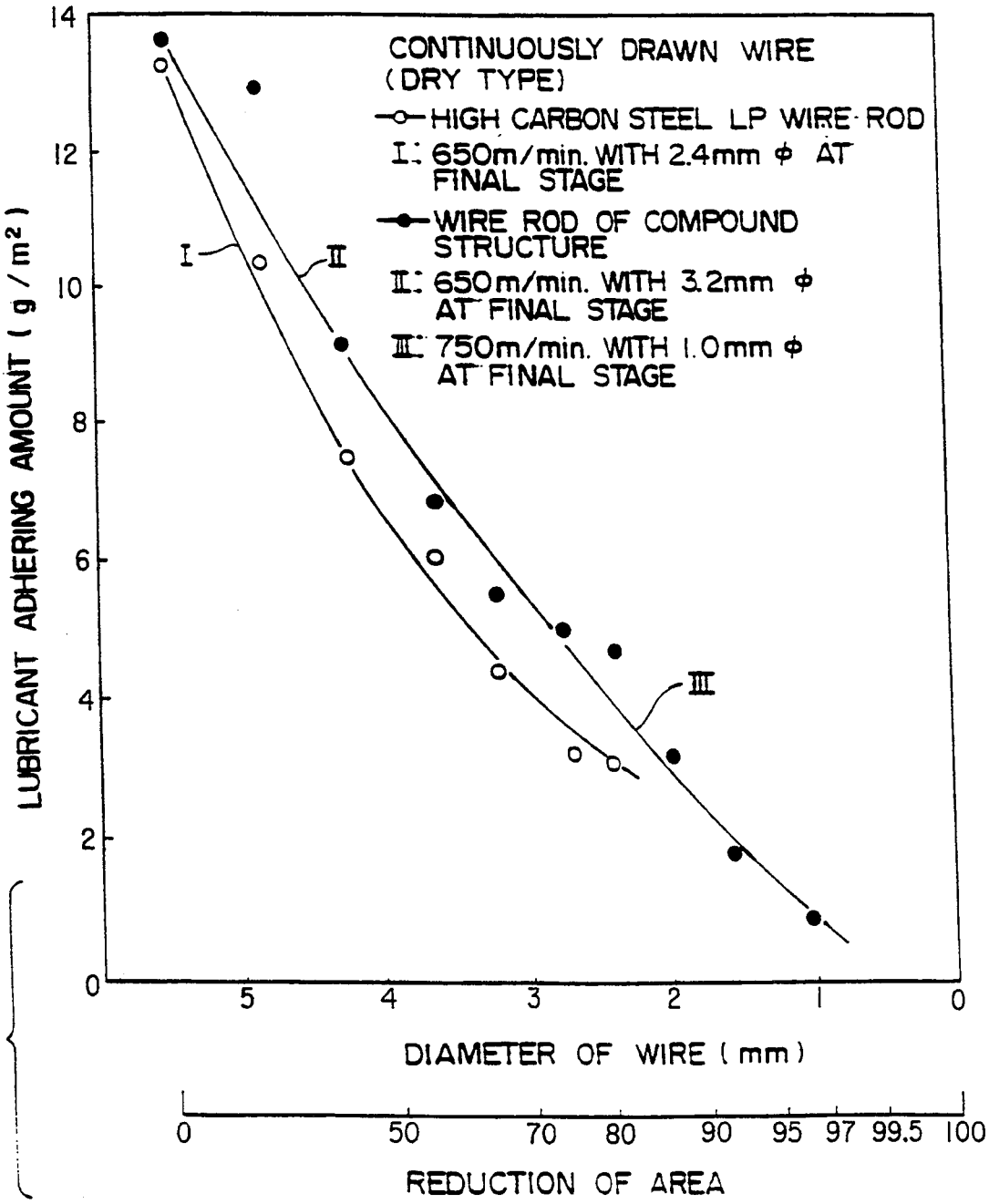
FIG. 13 is a graph showing the relationship between the reduction or area and the amount of the lubricant deposited when a conventional high carbon steel and a wire rod of composite structure used in this invention respectively are subjected to dry continuous wire drawing.

In the course of drawing the wire rod C into ultra-fine steel wires of 0.06 mm diameter (total reduction of area 99.99%), the rod was once drawn into a wire rod of 0.58 mm and 0.15 mm diameter and subjected to the heat treatments as shown in FIG. 12. FIG. 12 the relationship between the drawing strain and the tensile strength of the obtained drawn wire. That is, according to this invention, high strength and highly ductile ultra-fine steel wire having a final strength greater than 300 kgf/mm$^2$ could be obtained while adjusting the strength of the drawn wire rod during the course of the drawing to less than 300 kgf/mm$^2$ and improving the life of the drawing dies as shown in the drawing.

As a comparison, wire rod C was drawn down to 0.15 mm diameter without applying heat treatment in the course of the step. As shown in the figure together with the result, it is apparent that the strength remarkably increased along with the wire drawing and an unfavorable effect was exhibited in the die life and on the characteristics of the drawn wire rod.

EXAMPLE 5

Steels represented by the references A and B shown in Table 8 were hot rolled into wire rods of 5.5 mm diameter, cooled with water into structures mainly composed of martensite respectively, heated to 820° C. and cooled at a rate of 80° C./sec to prepare a mixed structure of ferrite and acicular martensite, which was referred to as A2 and B2 corresponding to the steels A and B respectively. While on the other hand, the steels represented by the reference A was treated in the same manner except that the cooling rate was reduced 15° C./sec after the heating in the heat treatment, which is referred to as A1. Table 9 shows the volume ratio of the secondary phase, grain size and the configuration, as well as the tensile properties of the wire rods A1, A2 and B2 of the composite structure after the heat treatment. Since wire rod A1 was composed of a composite structure mainly comprising the acicular secondary phase and a partially bulky secondary phase, it exhibited somewhat inferior ductility in comparison to wire rods A2 and B2. Wire rod B2 had a low A1 content and higher ductility than A2.

Table 10 shows the mechanical properties of drawn wires obtained by pickling wire rode A1 and A2 of 5.5 mm diameter, brass-plating the rods with Cu or Cu 65% - Zn 35% and by continuously cold wire drawing at a total reduction of area at 97%. Table 10 also shows the mechanical properties of drawn wires prepared by pickling the same wire rods A1 and A2, applying a conventional lubricating treatment of phosphate coating and then continuously cold drawing the wire together for the comparison.

TABLE 8

| Reference for steel | Chemical composition (wt %) | | | | | |
|---|---|---|---|---|---|---|
| | C | Si | Mn | S | Al | N |
| A | 0.07 | 0.50 | 1.49 | 0.003 | 0.006 | 0.003 |
| B | 0.08 | 0.53 | 1.50 | 0.002 | 0.002 | 0.002 |

TABLE 9

| Reference for steel | Secondary phase ratio (%) | Secondary phase grain size (μ) | Secondary phase Grain configuration (a) | Tensile strength (kg/mm$^2$) | Reduction (%) | Remark |
|---|---|---|---|---|---|---|
| A1 | 14 | 1.9 | Δ | 61 | 70 | Wire rod of the invention |
| A2 | 20 | 1.5 | ○ | 69 | 76 | Wire rod of the invention |
| B2 | 22 | 1.7 | ○ | 70 | 80 | Wire rod of the invention |

(a) Same as in Table 4

TABLE 10

| Reference for steel | pretreatment for drawing | drawn wire diameter (mm) | Strength (kg/mm$^2$) | Reduction (%) | working degree for drawing (%) | Lubricant deposition amount (g/mm$^2$) | Remark |
|---|---|---|---|---|---|---|---|
| A1 | plating (a) | 0.95 | 193 | 46 | 97 | — | this invention |
| | ordinary lubricant | 0.95 | 189 | 10 or less | 97 | 1.1 | comparative example |
| A2 | plating (b) | 0.95 | 207 | 58 | 97 | — | this invention |
| | ordinary lubricant | 0.95 | 203 | 55 | 97 | 0.9 | comparative example |

(note)
(a) Cu
(b) Cu 65% - Zn 35%

TABLE 11

| Reference for steel | Plating | Drawn wire diameter (mm) | Working degree (%) | Strength (kg/mm$^2$) | Reduction (%) | Close bondability with rubber |
|---|---|---|---|---|---|---|
| A2 | none | 0.29 | 99.7 | 274 | 44 | |
| | brass-plated to 1.5 mm dia drawn wire (a) | 0.29 | 99.7 | 288 | 43 | ordinary |
| | brass-plated to 5.5 mm dia wire rod (b) | 0.25 | 99.8 | 302 | 55 | good |
| B2 | none | 0.25 | 99.8 | 303 | 54 | |
| | brass-plated to 5.5 mm dia wire rod | 0.25 | 99.8 | 312 | 57 | good |
| | brass-plated to 5.5 mm dia wire rod | 0.25 | 99.8 | 310 | 56 | particularly good |

(note)
(a) Cu 64%-36% Zn
Cu 55%-45% Zn

Both of the wire rods A1 and A2 provided with a lubricating treatment by ordinary phosphate coating as the pretreatment to the wire drawing contained less deposition amount and resulted in poor lubricancy. While on the other hand, in the case or applying brass-plating before the wire drawing, undesired effect of the drawn wire could be avoided due to the lubricancy of the plating present at the surface of the drawn wire, for example, if the amount of powdered lubricant introduced upon wire drawing work was insufficient, as seen in the drawn wire from the wire rod A1. That is, according to this invention, the lubricanting property upon wire drawing was improved as a result of the brass-plating before the wire drawing. Further, it is apparent that the ductility was improved in the drawing of the wire rod A2.

Further, the wire drawing property and the close bondability with rubber were evaluated for the drawn wire obtained by pickling the wire rod A2 of 5.5 mm diameter in a composite structure excellent in intense workability, applying ordinary phosphate treatment and drawling without plating treatment into a diameter of 0.29 mm (working rate of 99.7%) (comparative example), for the drawn wire obtained by applying brass plating to the drawn wire of 1.5 mm diameter and having a tensile strength at 179 kgf/mm$^2$ in the course of the drawing and then applying the wire drawing again down to 0.29 mm diameter (this invention) and for the drawn wire obtained by brass-plating a wire rod of 5.5 mm diameter after pickling and then drawing down to 0.29 mm diameter (drawn wire of the invention). The results are shown in Table 11. The composition of the brass-plating was Cu 64% - Zn 36% for the wire rod A2, Cu 64% - Zn 36% or Cu 55% - Zn 45% for the wire rod B2. The drawn wire according to this invention exhibited excellent ductility and exhibited excellent close bondability with the rubber.

Next, wire rod B2 of the composite structure excellent in intense workability was also drawn after brass-plating the wire rod of 5.5 mm diameter before drawing. Table 11 also shows the wire drawing property and the close bondability with rubber also for drawn wires (of the invention). Excellent wire drawing properties could be obtained irrespective of the Zn concentration in the brass-plating and they exhibited excellent drawing properties. Further, it is apparent that the wire rod brass-plated with a high Zn concentration exhibited excellent close bondability to rubber. In this way, one of the important features of this invention is that a preferred wire drawing property can be ensured even for wire rods subjected to brass-plating at high Zn concentration.

What is claimed is:

1. A method of producing ultra-fine steel wires by applying continuous cold drawing, at a reduction of area greater than 90%, to a wire rod having a composite structure in which an acicular low temperature transformation phase comprising a martensite, bainite and/or a mixed structure thereof, which comprises: by weight percent, 0.02–0.30% carbon, less than 2.5% Si, less than 2.5% Mn and the balance iron and the inevitable impurities, said wire having a ferrite phase containing retained austenite uniformly dispersed at a volume ratio of from 10 to 70% throughout the ferrite phase, and wherein the weight of (C+N) in solution in the ferrite phase is less than 40 ppm, wherein the volume ratio of the low temperature transformation phase is set to within the range of from 10 to 95% and wherein the wire rod, after reheating of the wire rod to about 800° C., is cooled, such that within the temperature range of from 550° to 200° C., the rate of cooling is less than 40° C./sec, and before drawing or during drawing, plating said-wire rod with brass.

2. The method of claim 1, wherein the wire rod, prior to cold drawing, is again heated for more than 5 seconds within a temperature range of from 600° to 200° C., and thereafter, but prior to cold drawing, subjecting the wire rod to an overaging treatment.

3. The method of claim 1, wherein said wire rod is continuously drawn at a drawing rate of greater than 20 m/min.

4. The method of claim 1, wherein said composite structure comprises less than 0.01% by weight of aluminum, less than 0.01% by weight phosphorous, less than 0.005% by weight sulfur, less than 0.004% by weight nitrogen, said structure having a Si/Al ratio of less than 400 and a Si/Mn ratio of less than 0.7.

5. The method of claim 1, wherein said volume ratio of the low temperature transformation phase is set within the range of from 10 to 70%.

6. The method of claim 1, which further comprises, after drawing the wire to a reduction of area of greater than 90%, heating the wire to a temperature below the recrystallization point of the wire during further drawing of the wire, and subsequently cooling the wire.

* * * * *

UNITED STATES PATENT AND TRADEMARK OFFICE

CERTIFICATE OF CORRECTION

PATENT NO. : 5,338,380

DATED : August 16, 1994

INVENTOR(S) : Toshiaki YUTORI, et al.

It is certified that error appears in the above-indentified patent and that said Letters Patent is hereby corrected as shown below:

On the title page, Item[75], Masaaki Katsumata, Nishi, should be deleted from the inventorship.

Signed and Sealed this

Sixth Day of December, 1994

*Attest:*

Bruce Lehman

BRUCE LEHMAN

*Attesting Officer*

*Commissioner of Patents and Trademarks*